US010789922B2

(12) United States Patent
Danjyo et al.

(10) Patent No.: US 10,789,922 B2
(45) Date of Patent: Sep. 29, 2020

(54) ELECTRONIC MUSICAL INSTRUMENT, ELECTRONIC MUSICAL INSTRUMENT CONTROL METHOD, AND STORAGE MEDIUM

(71) Applicant: CASIO COMPUTER CO., LTD., Tokyo (JP)

(72) Inventors: Makoto Danjyo, Saitama (JP); Fumiaki Ota, Tokyo (JP); Masaru Setoguchi, Tokyo (JP); Atsushi Nakamura, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/384,883

(22) Filed: Apr. 15, 2019

(65) Prior Publication Data

US 2019/0318715 A1 Oct. 17, 2019

(30) Foreign Application Priority Data

Apr. 16, 2018 (JP) ..... 2018-078113

(51) Int. Cl.
*G10H 1/00* (2006.01)
*G10H 1/36* (2006.01)

(52) U.S. Cl.
CPC ..... *G10H 1/366* (2013.01); *G10H 1/0016* (2013.01); *G10H 2210/005* (2013.01); *G10H 2210/066* (2013.01); *G10H 2210/071* (2013.01)

(58) Field of Classification Search
CPC ..... G10H 2210/066; G10H 2220/011; G10H 2210/251; G10H 7/00; G10H 5/005;
(Continued)

(56) References Cited

U.S. PATENT DOCUMENTS 6,337,433 B1 * 1/2002 Nishimoto ..... A63J 17/00 84/464 A
8,008,563 B1 * 8/2011 Hastings ..... G09B 15/023 84/470 R (Continued)

FOREIGN PATENT DOCUMENTS

JP H04-238384 A 8/1992
JP H06-332449 A 12/1994

(Continued)

OTHER PUBLICATIONS

Kei Hashimoto and Shinji Takaki, "Statistical parametric speech synthesis based on deep learning", Journal of the Acoustical Society of Japan, vol. 73, No. 1 (2017), pp. 55-62. (Cited in the related U.S. Appl. No. 16/384,861 as a concise explanation of relevance.).

(Continued)

*Primary Examiner* — Marlon T Fletcher
(74) *Attorney, Agent, or Firm* — Chen Yoshimura LLP

(57) ABSTRACT

An electronic musical instrument in one aspect of the disclosure includes; a plurality of operation elements to be performed by a user for respectively specifying different pitches; a memory that stores musical piece data that includes data of a vocal part, the vocal part including at least a first note with a first pitch and an associated first lyric part that are to be played at a first timing; and at least one processor, wherein if the user does not operate any of the plurality of operation elements in accordance with the first timing, the at least one processor digitally synthesizes a default first singing voice that includes the first lyric part and that has the first pitch in accordance with data of the first note stored in the memory, and causes the digitally synthesized default first singing voice to be audibly output at the first timing.

13 Claims, 14 Drawing Sheets

(58) Field of Classification Search
CPC ..... G10H 2240/145; G10H 2250/455; G10H 2240/325; G10H 2210/005; G10H 2210/031; G10L 13/033; G10L 2025/906; G10G 1/00; G10G 1/02; G10C 3/12; G10F 1/02; G10K 15/02
See application file for complete search history.

(56) References Cited

U.S. PATENT DOCUMENTS

| | | | | |
|---|---|---|---|---|
| 2002/0017187 | A1* | 2/2002 | Takahashi | G09B 15/023 84/478 |
| 2003/0009344 | A1* | 1/2003 | Kayama | G10L 13/06 704/500 |
| 2005/0257667 | A1 | 11/2005 | Nakamura | |
| 2014/0006031 | A1 | 1/2014 | Mizuguchi et al. | |
| 2017/0140745 | A1* | 5/2017 | Nayak | H04L 65/605 |
| 2018/0277075 | A1* | 9/2018 | Nakamura | G10H 1/46 |
| 2018/0277077 | A1* | 9/2018 | Nakamura | G10H 1/38 |
| 2019/0096372 | A1* | 3/2019 | Setoguchi | G10H 1/0016 |
| 2019/0096379 | A1* | 3/2019 | Iwase | G10H 1/06 |
| 2019/0198001 | A1* | 6/2019 | Danjyo | G09B 15/00 |
| 2019/0318712 | A1* | 10/2019 | Nakamura | G10H 1/366 |
| 2019/0318715 | A1* | 10/2019 | Danjyo | G10H 1/0066 |
| 2019/0392798 | A1* | 12/2019 | Danjyo | G10H 7/008 |
| 2019/0392799 | A1* | 12/2019 | Danjyo | G10H 1/0008 |
| 2019/0392807 | A1* | 12/2019 | Danjyo | G10H 1/0008 |

FOREIGN PATENT DOCUMENTS

| | | | |
|---|---|---|---|
| JP | 2005-331806 | A | 12/2005 |
| JP | 2014-10190 | A | 1/2014 |
| JP | 2014-62969 | A | 4/2014 |
| JP | 2016-206323 | A | 12/2016 |
| JP | 2017-97176 | A | 6/2017 |
| JP | 2017-194594 | A | 10/2017 |

OTHER PUBLICATIONS

U.S. Appl. No. 16/384,861, filed Apr. 15, 2019.
Japanese Office Action dated May 28, 2019, in a counterpart Japanese patent application No. 2018-078113. (A machine translation (not reviewed for accuracy) attached.).
Japanese Office Action dated May 28, 2019, in a counterpart Japanese patent application No. 2018-078110. (Cited in the related U.S. Appl. No. 16/384,861 and a machine translation (not reviewed for accuracy) attached.).

* cited by examiner

| | | | |
|---|---|---|---|
| Header chunk | | ChunkID | Fixed string "MThd" = 0x4d546864 |
| | | ChunkSize | Length of header chunk = 0x00000006 |
| | | FormatType | Format: e.g., 0x0001 |
| | | NumberOfTrack | Number of tracks: e.g., 0x0002 |
| | | TimeDivision | Timebase: e.g., 0x1e0 |
| First track chunk (lyric part) | | ChunkID | Fixed string "MTrk" = 0x4d54726b |
| | | ChunkSize_1 | Length of first track chunk |
| | DeltaTime_1[0] | DeltaTime | Wait time since last event |
| | Event_1[0] | Event | Event |
| | DeltaTime_1[1] | DeltaTime | Wait time since last event |
| | Event_1[1] | Event | Event |
| | ... | ... | |
| | DeltaTime_1[L−1] | DeltaTime | Wait time since last event |
| | Event_1[L−1] | Event | Must have "End of Track" at end of track |
| Second track chunk (accompaniment part) | | ChunkID | Fixed string "MTrk" = 0x4d54726b |
| | | ChunkSize_2 | Length of second track chunk |
| | DeltaTime_2[0] | DeltaTime | Wait time since last event |
| | Event_2[0] | Event | Event |
| | DeltaTime_2[1] | DeltaTime | Wait time since last event |
| | Event_2[1] | Event | Event |
| | ... | ... | |
| | DeltaTime_2[M−1] | DeltaTime | Wait time since last event |
| | Event_2[M−1] | Event | Must have "End of Track" at end of track |

FIG. 6

```
<note default-x="14">
  <pitch>
    <step>E</step>
    <octave>4</octave>
  </pitch>
  <duration>2</duration>
  <voice>1</voice>
  <type>quarter</type>
  <stem default-y="-4">up</stem>
  <lyric default-y="-80" number="1">
    <syllabic>single</syllabic>
    <text font-family="-3 ">Ki</text>
  </lyric>
</note>
```

FIG. 13

ELECTRONIC MUSICAL INSTRUMENT, ELECTRONIC MUSICAL INSTRUMENT CONTROL METHOD, AND STORAGE MEDIUM

BACKGROUND OF THE INVENTION

Technical Field

The present invention relates to an electronic musical instrument that generates a singing voice in accordance with the operation of an operation element on a keyboard or the like, an electronic musical instrument control method, and a storage medium.

Background Art

In one conventional technology, an electronic musical instrument is configured so as to generate a singing voice (vocals) in accordance with the operation of an operation element on a keyboard or the like (for example, see Patent Document 1). This conventional technology includes a keyboard operation element for instructing pitch, a storage unit in which lyric data is stored, an instruction unit that gives instruction to read lyric data from the storage unit, a read-out unit that sequentially reads lyric data from the storage unit when there has been an instruction from the instruction unit, and a sound source that generates a singing voice at a pitch instructed by the keyboard operation element and with a tone color corresponding to the lyric data read by the read-out unit.

RELATED ART DOCUMENTS

Patent Documents

Patent Document 1: Japanese Patent Application Laid-Open Publication No. H06-332449

SUMMARY OF THE INVENTION

However, with conventional technology such as described above, when, for example, attempting to output singing voices corresponding to lyrics in time with the progression of accompaniment data that is output by the electronic musical instrument, if singing voices corresponding to the lyrics are progressively output each time a key is specified by a user no matter which key has been specified, depending on the way the keys were specified by the user, the progression of accompaniment data and singing voices being output may not be in time with one another. For example, in cases where a single measure contains four musical notes for which the respective timings at which sound is generated are mutually distinct, lyrics will run ahead of the progression of accompaniment data when a user specifies more than four pitches within this single measure, and lyrics will lag behind the progression of accompaniment data when a user specifies three or fewer pitches within this single measure.

If lyrics are progressively advanced in this manner each time a user specifies a pitch with a keyboard or the like, the lyrics may, for example, run too far ahead of the accompaniment, or conversely, the lyrics may lag too far behind the accompaniment.

A similar issue exists with respect to the progression of lyrics even when no accompaniment data is output, that is, when only a singing voice is output. Accordingly, the present invention is directed to a scheme that substantially obviates one or more of the problems due to limitations and disadvantages of the related art.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument that includes: a performance receiver having a plurality of operation elements to be performed by a user for respectively specifying different pitches of musical notes; a memory that stores musical piece data that includes data of a vocal part, the vocal part including at least a first note with a first pitch and an associated first lyric part that are to be played at a first timing; and at least one processor, wherein the at least one processor performs the following: if the user specifies, via the performance receiver, a pitch in accordance with the first timing, digitally synthesizing a played first singing voice that includes the first lyric part and that has the pitch specified by the user regardless of whether the pitch specified by the user coincides with the first pitch, and causing the digitally synthesized played first singing voice to be audibly output at the first timing; and if the user does not operate any of the plurality of operation elements of the performance receiver in accordance with the first timing, digitally synthesizing a default first singing voice that includes the first lyric part and that has the first pitch in accordance with data of the first note stored in the memory, and causing the digitally synthesized default first singing voice to be audibly output at the first timing.

In another aspect, the present disclosure provides a method performed by the at least one processor in the above-mentioned electronic musical instrument, the method including the above-mentioned features performed by the at least one processor.

In another aspect, the present disclosure provides a non-transitory computer-readable storage medium having stored thereon a program executable by the above-mentioned at least one processor in the above-mentioned electronic musical instrument, the program causing the at least one processor to perform the above-mentioned features performed by the at least one processor.

According to the present invention, an electronic musical instrument that satisfactorily controls the progression of lyrics can be provided.

It is to be understood that both the foregoing general description and the following detailed description are exemplary and explanatory, and are intended to provide further explanation of the invention as claimed.

BRIEF DESCRIPTION OF THE DRAWINGS

FIG. 6 is a diagram illustrating an example data configuration in the embodiment.

FIG. 13 illustrates an example configuration of lyric control data in the MusicXML format.

DETAILED DESCRIPTION OF EMBODIMENTS

Embodiments of the present invention will be described in detail below with reference to the drawings.

Figure 1:
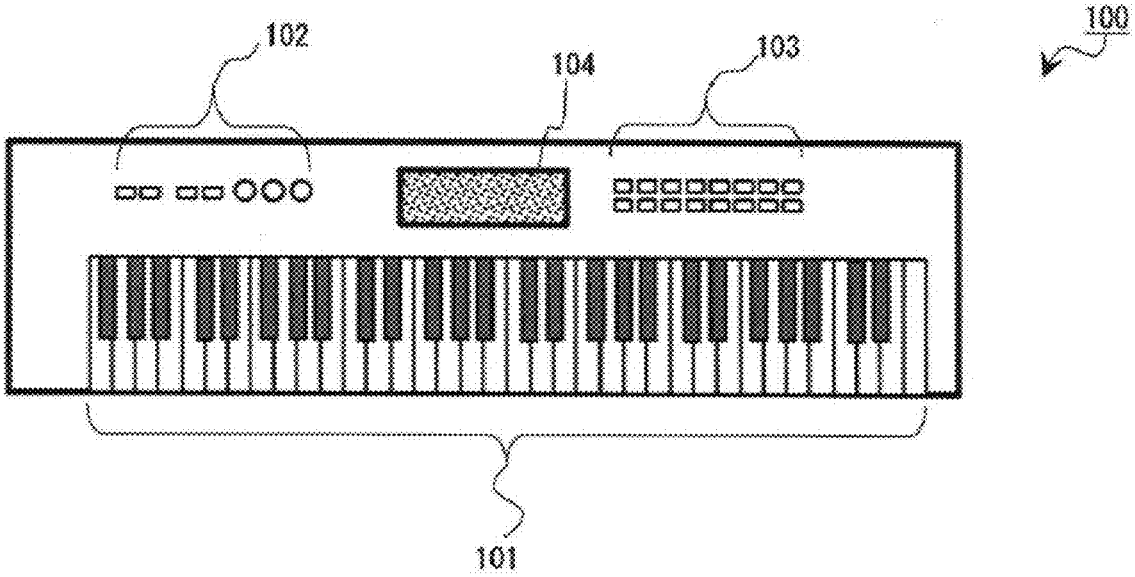
FIG. 1 is a diagram illustrating an example external view of an embodiment of an electronic keyboard instrument of the present invention.

FIG. 1 is a diagram illustrating an example external view of an embodiment of an electronic keyboard instrument 100 of the present invention. The electronic keyboard instrument 100 is provided with, inter alia, a keyboard 101, a first switch panel 102, a second switch panel 103, and a liquid crystal display (LCD) 104. The keyboard 101 is made up of a plurality of keys, including a first operation element and a second operation element, serving as a performance receiver having a plurality of operation elements to be operated by the user. The first switch panel 102 is used to specify various settings such as specifying volume, setting a tempo for song playback, initiating song playback, and playback of accompaniment. The second switch panel 103 is used to make song and accompaniment selections, select tone color, and so on. The liquid crystal display (LCD) 104 displays a musical score and lyrics during the playback of a song, and information relating to various settings. Although not illustrated in the drawings, the electronic keyboard instrument 100 is also provided with a speaker that emits musical sounds generated by playing of the electronic keyboard instrument 100. The speaker is provided at the underside, a side, the rear side, or other such location on the electronic keyboard instrument 100.

Figure 2:
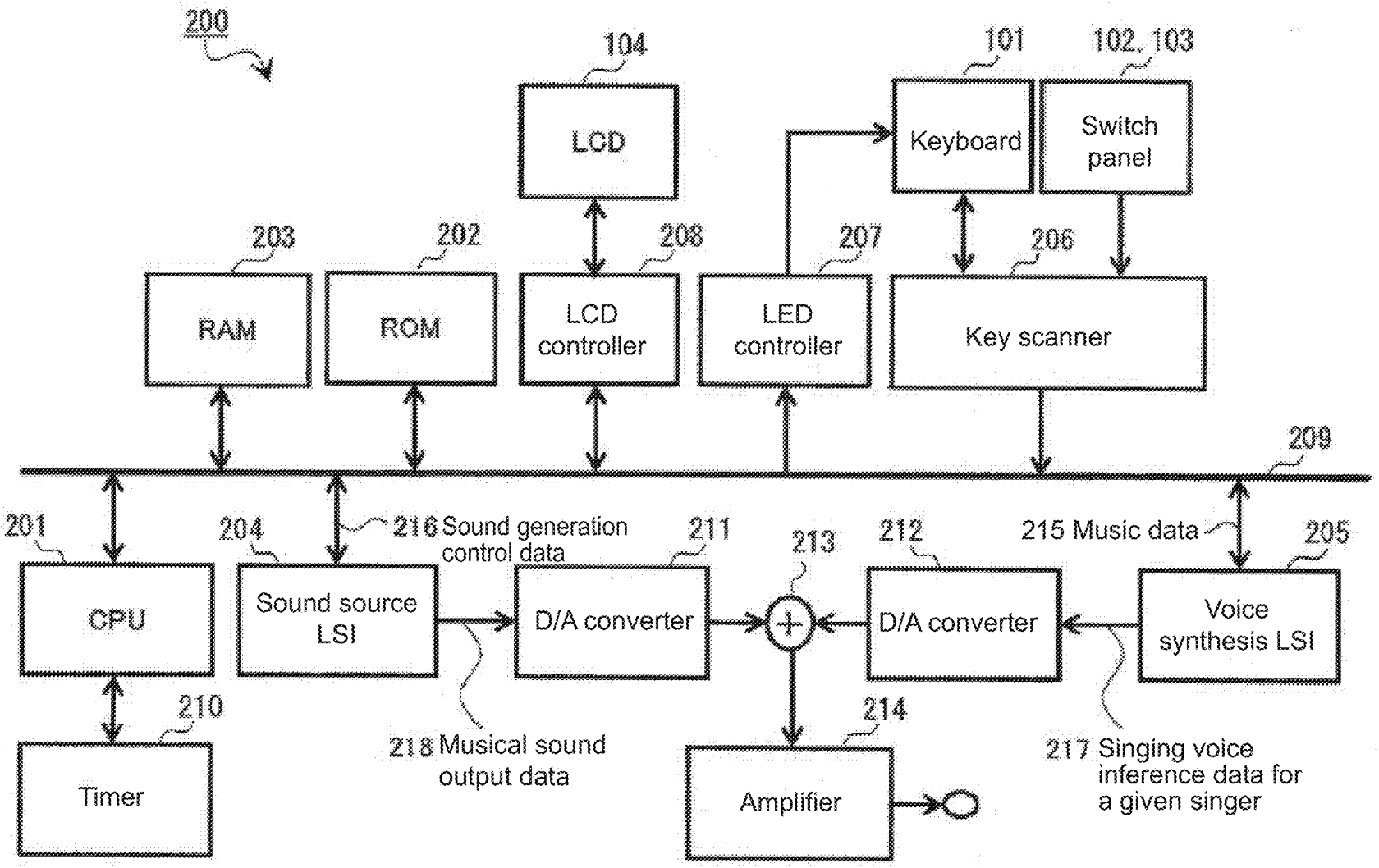
FIG. 2 is a block diagram illustrating an example hardware configuration for an embodiment of a control system of the electronic keyboard instrument.

FIG. 2 is a diagram illustrating an example hardware configuration for an embodiment of a control system 200 in the electronic keyboard instrument 100 of FIG. 1. In the control system 200 in FIG. 2, a central processing unit (CPU) 201, a read-only memory (ROM) 202, a random-access memory (RAM) 203, a sound source large-scale integrated circuit (LSI) 204, a voice synthesis LSI 205, a key scanner 206, and an LCD controller 208 are each connected to a system bus 209. The key scanner 206 is connected to the keyboard 101, to the first switch panel 102, and to the second switch panel 103 in FIG. 1. The LCD controller 208 is connected to the LCD 104 in FIG. 1. The CPU 201 is also connected to a timer 210 for controlling an automatic performance sequence. Musical sound output data 218 output from the sound source LSI 204 is converted into an analog musical sound output signal by a D/A converter 211, and singing voice inference data for a given singer 217 output from the voice synthesis LSI 205 is converted into an analog singing voice sound output signal by a D/A converter 212. The analog musical sound output signal and the analog singing voice sound output signal are mixed by a mixer 213, and after being amplified by an amplifier 214, this mixed signal is output from an output terminal or the non-illustrated speaker.

While using the RAM 203 as working memory, the CPU 201 executes a control program stored in the ROM 202 and thereby controls the operation of the electronic keyboard instrument 100 in FIG. 1. In addition to the aforementioned control program and various kinds of permanent data, the ROM 202 stores music data including lyric data and accompaniment data.

The CPU 201 is provided with the timer 210 used in the present embodiment. The timer 210, for example, counts the progression of automatic performance in the electronic keyboard instrument 100.

In accordance with a sound generation control instruction from the CPU 201, the sound source LSI 204 reads musical sound waveform data from a non-illustrated waveform ROM, for example, and outputs the musical sound waveform data to the D/A converter 211. The sound source LSI 204 is capable of 256-voice polyphony.

When the voice synthesis LSI 205 is given, as music data 215, information relating to lyric text data, pitch, duration, and starting frame by the CPU 201, the voice synthesis LSI 205 synthesizes voice data for a corresponding singing voice and outputs this voice data to the D/A converter 212.

The key scanner 206 regularly scans the pressed/released states of the keys on the keyboard 101 and the operation states of the switches on the first switch panel 102 and the second switch panel 103 in FIG. 1, and sends interrupts to the CPU 201 to communicate any state changes.

The LCD controller 208 is an integrated circuit (IC) that controls the display state of the LCD 104.

Figure 3:
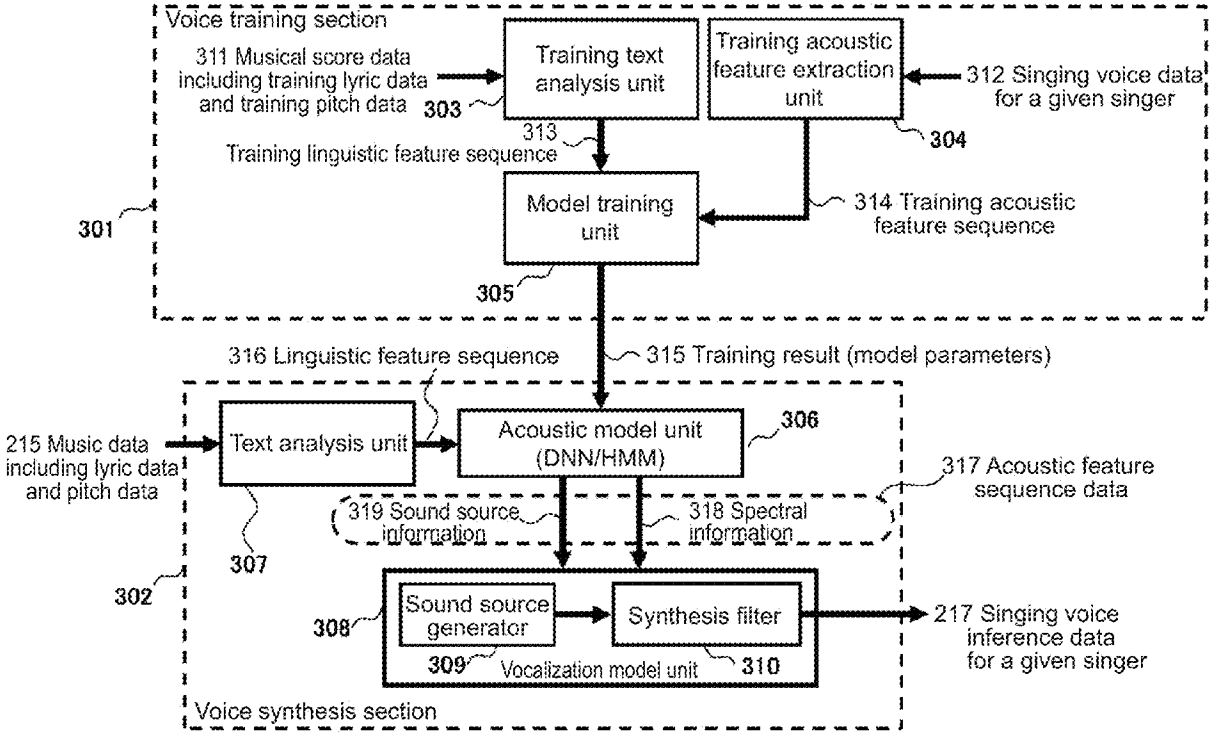
FIG. 3 is a block diagram illustrating an example configuration of a voice synthesis LSI.

FIG. 3 is a block diagram illustrating an example configuration of the voice synthesis LSI 205 in FIG. 2. The voice synthesis LSI 205 is input with music data 215 instructed by the CPU 201 in FIG. 2 as a result of song playback processing, described later. With this, the voice synthesis LSI 205 synthesizes and outputs singing voice inference data for a given singer 217 on the basis of, for example, the "statistical parametric speech synthesis based on deep learning" techniques described in the following document.

(Document)

Kei Hashimoto and Shinji Takaki, "Statistical parametric speech synthesis based on deep learning", Journal of the Acoustical Society of Japan, vol. 73, no. 1 (2017), pp. 55-62

The voice synthesis LSI 205 includes a voice training section 301 and a voice synthesis section 302. The voice training section 301 includes a training text analysis unit 303, a training acoustic feature extraction unit 304, and a model training unit 305.

The training text analysis unit 303 is input with musical score data 311 including lyric text, pitches, and durations, and the training text analysis unit 303 analyzes this data. In other words, the musical score data 311 includes training lyric data and training pitch data. The training text analysis unit 303 accordingly estimates and outputs a training linguistic feature sequence 313, which is a discrete numerical sequence expressing, inter alia, phonemes, parts of speech, words, and pitches corresponding to the musical score data 311.

The training acoustic feature extraction unit 304 receives and analyzes singing voice data 312 that has been recorded via a microphone or the like when a given singer sang the aforementioned lyric text. The training acoustic feature extraction unit 304 accordingly extracts and outputs a training acoustic feature sequence 314 representing phonetic features corresponding to the singing voice data for a given singer 312.

In accordance with Equation (1) below, the model training unit 305 uses machine learning to estimate an acoustic model $\hat{\lambda}$ with which the likelihood ($P(o|l,\lambda)$) that a training acoustic feature sequence 314 (o) will be generated given a training linguistic feature sequence 313 (l) and an acoustic model ($\lambda$) is maximized. In other words, a relationship between a linguistic feature sequence (text) and an acoustic feature sequence (voice sounds) is expressed using a statistical model, which here is referred to as an acoustic model.

$$\hat{\lambda}=\arg\max_{\lambda} P(o|l,\lambda) \quad (1)$$

The model training unit 305 outputs, as training result 315, model parameters expressing the acoustic model $\hat{\lambda}$ that have been calculated using Equation (1) through the employ of machine learning, and the training result 315 is set in an acoustic model unit 306 in the voice synthesis section 302.

The voice synthesis section 302 includes a text analysis unit 307, an acoustic model unit 306, and a vocalization model unit 308. The voice synthesis section 302 performs statistical voice synthesis processing in which singing voice inference data for a given singer 217, corresponding to music data 215 including lyric text, is synthesized by making predictions using the statistical model, referred to herein as an acoustic model, set in the acoustic model unit 306.

As a result of a performance by a user made in concert with an automatic performance, the text analysis unit 307 is input with music data 215, which includes information relating to lyric text data, pitch, duration, and starting frame, specified by the CPU 201 in FIG. 2, and the text analysis unit 307 analyzes this data. The text analysis unit 307 performs this analysis and outputs a linguistic feature sequence 316 expressing, inter alia, phonemes, parts of speech, words, and pitches corresponding to the music data 215.

The acoustic model unit 306 is input with the linguistic feature sequence 316, and using this, the acoustic model unit 306 estimates and outputs an acoustic feature sequence 317 corresponding thereto. In other words, in accordance with Equation (2) below, the acoustic model unit 306 estimates a value ($\hat{o}$) for an acoustic feature sequence 317 at which the likelihood ($P(o|l,\hat{\lambda})$) that an acoustic feature sequence 317 (o) will be generated based on a linguistic feature sequence 316 (l) input from the text analysis unit 307 and an acoustic model $\hat{\lambda}$ set using the training result 315 of machine learning performed in the model training unit 305 is maximized.

$$\hat{o}=\arg\max_{o} P(o|l,\hat{\lambda}) \quad (2)$$

The vocalization model unit 308 is input with the acoustic feature sequence 317. With this, the vocalization model unit 308 generates singing voice inference data for a given singer 217 corresponding to the music data 215 including lyric text specified by the CPU 201. The singing voice inference data for a given singer 217 is output from the D/A converter 212, goes through the mixer 213 and the amplifier 214 in FIG. 2, and is emitted from the non-illustrated speaker.

The acoustic features expressed by the training acoustic feature sequence 314 and the acoustic feature sequence 317 include spectral information that models the vocal tract of a person, and sound source information that models the vocal chords of a person. A mel-cepstrum, line spectral pairs (LSP), or the like may be employed for the spectral parameters. A fundamental frequency (F0) indicating the pitch frequency of the voice of a person may be employed for the sound source information. The vocalization model unit 308 includes a sound source generator 309 and a synthesis filter 310. The sound source generator 309 is sequentially input with a sound source information 319 sequence from the acoustic model unit 306. Thereby, the sound source generator 309, for example, generates a sound source signal that periodically repeats at a fundamental frequency (F0) contained in the sound source information 319 and is made up of a pulse train (for voiced phonemes) with a power value contained in the sound source information 319 or is made up of white noise (for unvoiced phonemes) with a power value contained in the sound source information 319. The synthesis filter 310 forms a digital filter that models the vocal tract on the basis of a spectral information 318 sequence sequentially input thereto from the acoustic model unit 306, and using the sound source signal input from the sound source generator 309 as an excitation signal, generates and outputs singing voice inference data for a given singer 217 in the form of a digital signal.

In the present embodiment, in order to predict an acoustic feature sequence 317 from a linguistic feature sequence 316, the acoustic model unit 306 is implemented using a deep neural network (DNN). Correspondingly, the model training unit 305 in the voice training section 301 learns model parameters representing non-linear transformation functions for neurons in the DNN that transform linguistic features into acoustic features, and the model training unit 305 outputs, as the training result 315, these model parameters to the DNN of the acoustic model unit 306 in the voice synthesis section 302.

Normally, acoustic features are calculated in units of frames that, for example, have a width of 5.1 msec, and linguistic features are calculated in phoneme units. Accordingly, the unit of time for linguistic features differs from that for acoustic features. The DNN acoustic model unit 306 is a model that represents a one-to-one correspondence between the input linguistic feature sequence 316 and the output acoustic feature sequence 317, and so the DNN cannot be trained using an input-output data pair having differing units of time. Thus, in the present embodiment, the correspondence between acoustic feature sequences given in frames and linguistic feature sequences given in phonemes is established in advance, whereby pairs of acoustic features and linguistic features given in frames are generated.

Figure 4:
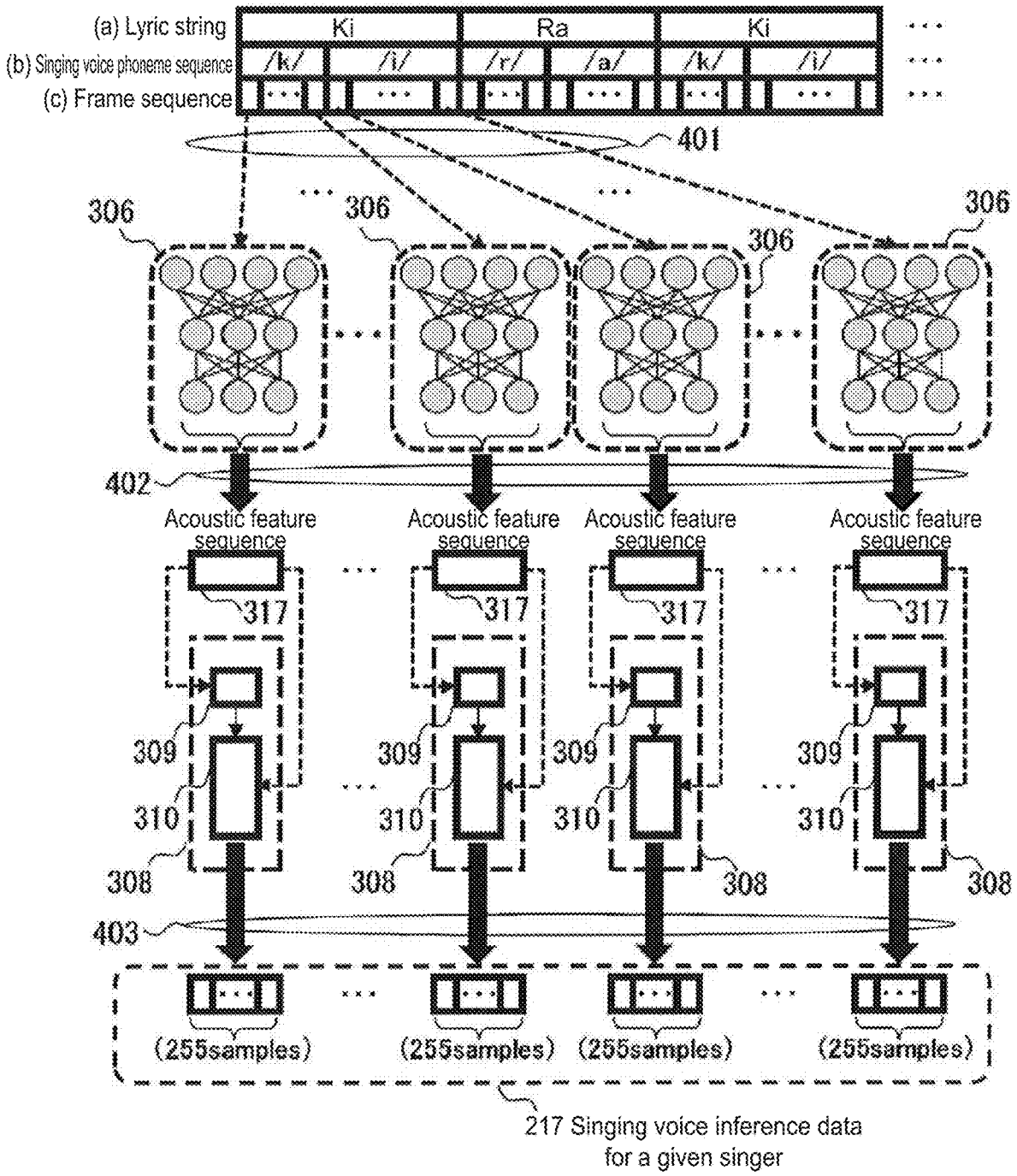
FIG. 4 is a diagram for explaining the operation of the voice synthesis LSI.

FIG. 4 is a diagram for explaining the operation of the voice synthesis LSI 205, and illustrates the aforementioned correspondence. For example, when the singing voice phoneme sequence (linguistic feature sequence) /k/ /i/ /r/ /a/ /k/ /i/ ((b) in FIG. 4) corresponding to the lyric string "Ki Ra Ki" ((a) in FIG. 4) at the beginning of a song has been acquired, this linguistic feature sequence is mapped to an acoustic feature sequence given in frames ((c) in FIG. 4) in a one-to-many relationship (the relationship between (b) and (c) in FIG. 4). It should be noted that because linguistic features are used as inputs to the DNN of the acoustic model unit 306, it is necessary to express the linguistic features as numerical data. Numerical data obtained by concatenating binary data (0 or 1) or continuous values responsive to contextual questions such as "Is the preceding phoneme /a/?" and "How many phonemes does the current word contain?" is prepared for the linguistic feature sequence for this reason.

The model training unit 305 in the voice training section 301 in FIG. 3, as depicted using the group of dashed arrows 401 in FIG. 4, trains the DNN of the acoustic model unit 306 by sequentially passing, in frames, pairs of individual phonemes in a training linguistic feature sequence 313 phoneme sequence (corresponding to (b) in FIG. 4) and individual frames in a training acoustic feature sequence 314 (corresponding to (c) in FIG. 4) to the DNN. The DNN of the acoustic model unit 306, as depicted using the groups of gray circles in FIG. 4, contains neuron groups each made up of an input layer, one or more middle layer, and an output layer.

During voice synthesis, a linguistic feature sequence 316 phoneme sequence (corresponding to (b) in FIG. 4) is input to the DNN of the acoustic model unit 306 in frames. The DNN of the acoustic model unit 306, as depicted using the group of heavy solid arrows 402 in FIG. 4, consequently outputs an acoustic feature sequence 317 in frames. For this reason, in the vocalization model unit 308, the sound source information 319 and the spectral information 318 contained in the acoustic feature sequence 317 are respectively passed to the sound source generator 309 and the synthesis filter 310 and voice synthesis is performed in frames.

The vocalization model unit 308, as depicted using the group of heavy solid arrows 403 in FIG. 4, consequently outputs 225 samples, for example, of singing voice inference data for a given singer 217 per frame. Because each frame has a width of 5.1 msec, one sample corresponds to 5.1 msec÷225≈0.0227 msec. The sampling frequency of the singing voice inference data for a given singer 217 is therefore 1/0.0227≈44 kHz (kilohertz).

The DNN is trained so as to minimize squared error. This is computed according to Equation (3) below using pairs of acoustic features and linguistic features denoted in frames.

$$\hat{\lambda}=\arg\min_{\lambda} \tfrac{1}{2}\Sigma_{t=1}^{T}\|o_t-g_\lambda(l_t)\|^2 \tag{3}$$

In this equation, $o_t$ and $l_t$ respectively represent an acoustic feature and a linguistic feature in the $t^{th}$ frame t, $\hat{\lambda}$ represents model parameters for the DNN of the acoustic model unit 306, and $g_\lambda(\cdot)$ is the non-linear transformation function represented by the DNN. The model parameters for the DNN are able to be efficiently estimated through back-propagation. When correspondence with processing within the model training unit 305 in the statistical voice synthesis represented by Equation (1) is taken into account, DNN training can represented as in Equation (4) below.

$$\begin{aligned}\hat{\lambda} &= \arg\max_{\lambda} P(o \mid l, \lambda) \\ &= \arg\max_{\lambda} \prod_{t=1}^{T} \mathcal{N}(o_t \mid \tilde{\mu}_t, \tilde{\Sigma}_t)\end{aligned} \tag{4}$$

Here, $\tilde{\mu}_t$ is given as in Equation (5) below.

$$\tilde{\mu}_t=g_\lambda(l_t) \tag{5}$$

As in Equation (4) and Equation (5), relationships between acoustic features and linguistic features are able to be expressed using the normal distribution $\mathcal{N}(o_t|\tilde{\mu}_t,\tilde{\Sigma}_t)$, which uses output from the DNN for the mean vector. Normally, in statistical voice synthesis processing employing a DNN, independent covariance matrices are used for linguistic features $l_t$. In other words, in all frames, the same covariance matrix $\tilde{\Sigma}_g$ is used for the linguistic features $l_t$. When the covariance matrix $\tilde{\Sigma}_g$ is an identity matrix, Equation (4) expresses a training process equivalent to that in Equation (3).

As described in FIG. 4, the DNN of the acoustic model unit 306 estimates an acoustic feature sequence 317 for each frame independently. For this reason, the obtained acoustic feature sequences 317 contain discontinuities that lower the quality of voice synthesis. Accordingly, a parameter generation algorithm that employs dynamic features, for example, is used in the present embodiment. This allows the quality of voice synthesis to be improved.

Figure 5A:
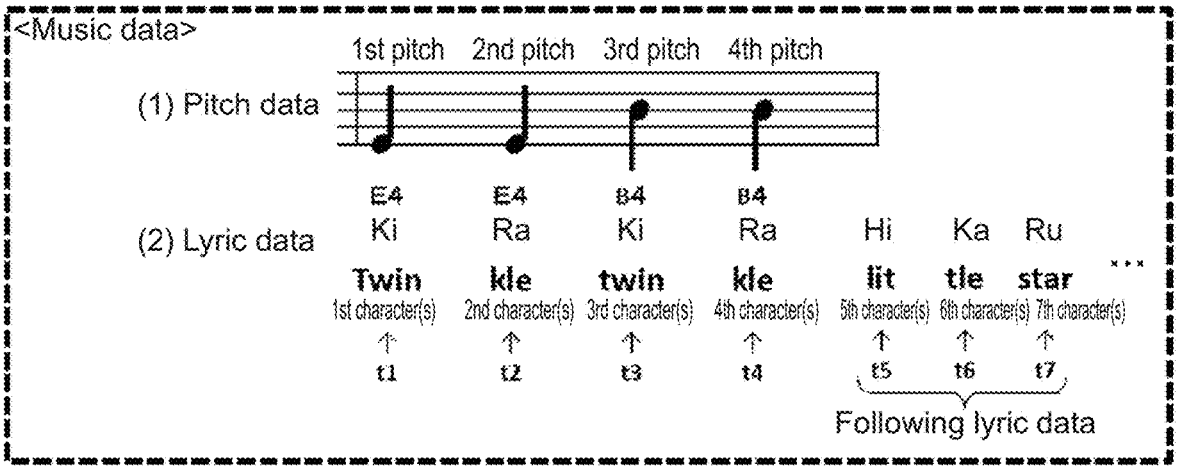
FIGS. 5A, 5B and 5C are diagrams for explaining lyric control techniques.
Figure 5B:
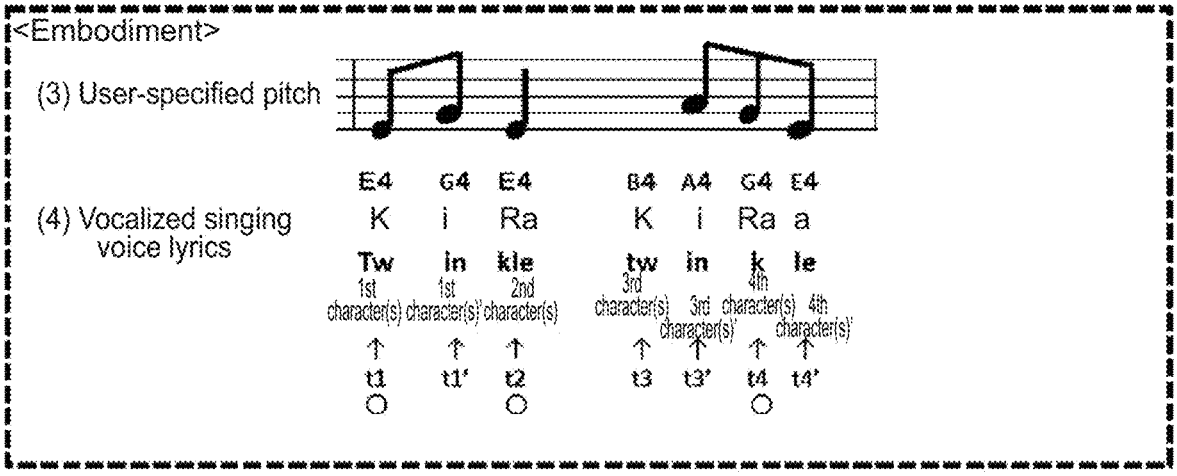
Figure 5C:
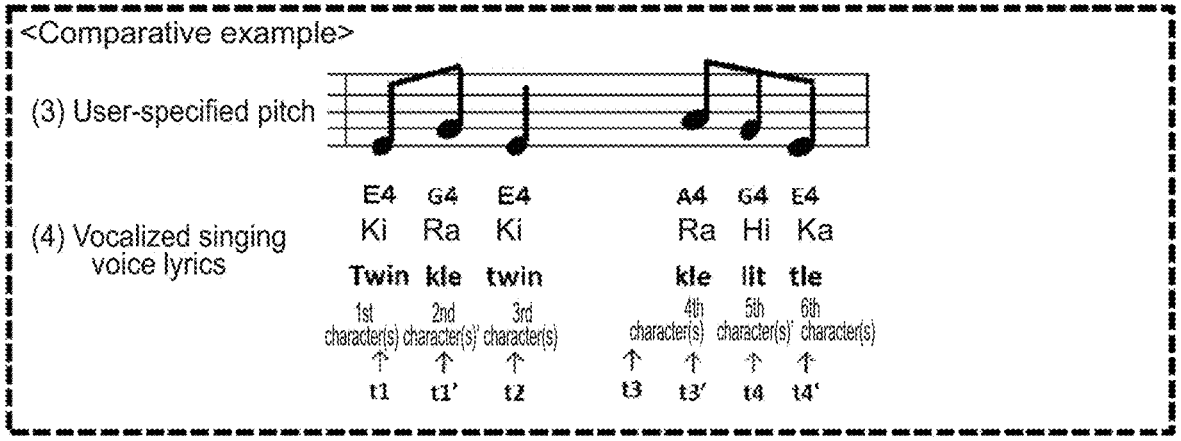

Detailed description follows regarding the operation of the present embodiment, configured as in the examples of FIGS. 1 to 3. FIGS. 5A through 5C are diagrams for explaining lyric control techniques. FIG. 5A is a diagram illustrating a relationship between a melody and lyric text that progresses in accordance with an automatic performance. For example, the music data at the beginning of the song mentioned above includes the lyric characters (lyric data) "Ki/Twin" (first character(s) or first lyric part), "Ra/kle" (second character(s)/lyric part), "Ki/twin" (third character(s)/lyric part), and "Ra/kle" (fourth character(s)/lyric part); timing information for t1, t2, t3, and t4, at which characters in the lyrics are output; and pitch data for the characters in the lyrics, e.g., the melody pitches E4 (first pitch), E4 (second pitch), B4 (third pitch), and B4 (fourth pitch). The timings t5, t6, t7 subsequent to t4 are associated with the characters in the lyrics "Hi/lit" (fifth character(s)), "Ka/tle" (sixth character(s)), and "Ru/star" (seventh character(s)).

The timings t1, t2, t3, t4 in FIG. 5B, for example, correspond to vocalization timings t1, t2, t3, t4 in FIG. 5A at which a user is supposed to operates the keyboard to specify prescribed pitches. Suppose that a user correctly pressed, twice, a key on the keyboard 101 in FIG. 1 having the same pitch E4 as the first pitch E4 indicated by pitch data included in the music data at timings t1 and t2, which correspond to original (i.e., correct) vocalization timings. In this case, the CPU 201 in FIG. 2 outputs, to the voice synthesis LSI 205 in FIG. 2, music data 215 containing, at timings corresponding to timings t1 and t2, the lyrics "Ki/Twin" (the first character(s)) and "Ra/kle" (the second character(s)), information indicating the pitch E4 specified by the user, and information indicating, for example, respective durations of quarter note length (obtained based on at least one of the music data or a user performance). Consequently, the voice synthesis LSI 205 outputs, at the first pitch (a specified pitch) E4 and the second pitch (a specified pitch) E4, respectively, singing voice inference data for a given singer 217 of quarter note length that corresponds to the lyrics "Ki/Twin" (the first character(s)) at timing t1 and "Ra/kle" (the second character(s)) at timing t2. The "○" evaluation markings at timings t1 and t2 indicate that vocalization was correctly performed in conformance with the pitch data and the lyric data included in the music data.

Now suppose that a user pressed the key on the keyboard 101 in FIG. 1 for the pitch G4, which differs from the original (i.e., correct) fourth pitch B4, at timing t4, which corresponds to an original (correct) vocalization timing. In this case, the CPU 201 outputs, to the voice synthesis LSI 205 in FIG. 2, music data 215 specifying the lyric "Ra/kle" (the fourth character(s)) at timing t4, specifying the pitch G4, which corresponds to the key performed at timing t4, and specifying, for example, a duration of an eighth note length. Consequently, the voice synthesis LSI 205 outputs, at the pitch G4 that had been performed (pressed), singing voice inference data for a given singer 217 of eighth note length that corresponds to the lyric "Ra/kle" (the fourth character(s)) at timing t4.

In the present embodiment, pitches specified by user operation are reflected in the singing voice inference data for a given singer 217 in cases where a user has performed a performance (key press) operation at a timing corresponding to an original vocalization timing. This allows the intention of the user to be better reflected in the singing voice being vocalized.

The following control is performed in cases where, at a timing corresponding to an original vocalization timing, a user does not press any of the keys on the keyboard 101 in FIG. 1 and no pitch is specified. At such a timing, the CPU 201 in FIG. 2 performs control such that a singing voice that corresponds to the character(s) (lyric data) corresponding to this timing is output at the pitch indicated by the pitch data included in the music data. Consequently, at this timing, the voice synthesis LSI 205 in FIGS. 2 and 3 outputs singing voice inference data for a given singer 217 that corresponds to the character(s) corresponding to this timing at the pitch indicated by the pitch data included in the music data.

Suppose that a user did not perform (press) a key on the keyboard 101 in FIG. 1 at, for example, timing t3 in FIG. 5B, which corresponds to an original vocalization timing. In this case, in other words, in cases where operation information for an operated operation element indicating "note on" is not received within a prescribed time frame before a first timing indicating a timing corresponding to a first timing indicated by data included in the music data, the CPU 201 in FIG. 2 outputs, to the voice synthesis LSI 205 in FIG. 2, music data 215 specifying that a singing voice corresponding to the "Ki/twin" (the third character(s)) lyric data corresponding to timing t3 is to be output at the third pitch B4 indicated by the pitch data included in the music data. Consequently, at timing t3, the voice synthesis LSI 205 in FIGS. 2 and 3 outputs singing voice inference data for a given singer 217 that corresponds to the "Ki/twin" (the third character(s)) lyric data corresponding to timing t3 at the corresponding third pitch B4.

Timing t3 in FIG. 5C is used to describe control operation if the above-described control operation of the present embodiment were not performed in cases where, in accordance with timing t3, which corresponds to an original vocalization timing, a user did not press a key on the keyboard 101 in FIG. 1. If the control operation of the present embodiment were not performed, the "Ki/twin" (the third character(s)) lyric string that should be vocalized at timing t3 in FIG. 5C will not be vocalized.

In this way, in cases where a user does not perform a performance operation at an original vocalization timing, a lyric string that should be vocalized will not be vocalized if the control operation of the present embodiment is not performed. This results in an unnatural-sounding progression. For example, if a melody were being performed in time with an automatic accompaniment, output of the automatic accompaniment would run ahead of output of the singing voice corresponding to the lyrics. However, in the present embodiment, in cases where a user does not perform a performance operation at an original vocalization timing, it is possible to output a singing voice that corresponds to the lyric data (character(s)) included in the music data corresponding to this timing at the pitch included in the music data corresponding to this lyric data (character(s)). This enables lyric progression to proceed naturally in the present embodiment.

If, at a timing at which no original vocalization timing comes, a user has performed a key press operation on a key (operation element) on the keyboard 101 in FIG. 1, the CPU 201 in FIG. 2 instructs the pitch of the singing voice corresponding to the singing voice inference data for a given singer 217 being output from the voice synthesis LSI 205 to be changed to the pitch specified by this performance operation. Consequently, at this timing at which no original vocalization timing comes, the voice synthesis LSI 205 in FIGS. 2 and 3 changes the pitch of the singing voice inference data for a given singer 217 being vocalized to the pitch specified by the CPU 201.

Suppose that a user pressed the keys on the keyboard 101 in FIG. 1 for the pitches G4, A4, and E4 at, for example, the respective timings t1', t3', and t4' in FIG. 5B, which are timings at which none of the original vocalization timings t1, t2, t3, t4 come. In this case, the CPU 201 outputs, to the voice synthesis LSI 205 in FIG. 2, music data 215 instructing that the pitches E4, B4, and G4 of respective singing voice inference data for a given singer 217 for the "Ki/Twin" (the first character(s)), "Ki/twin" (the third character(s)), and "Ra/kle" (the fourth character(s)) lyric strings that have been output from the voice synthesis LSI 205 are to be respectively changed to the pitches G4, A4, and E4 that were specified by the performance operation, and that vocalization of this singing voice inference data for a given singer 217 is to be continued. Consequently, at the timings t1', t3', and t4', the voice synthesis LSI 205 in FIGS. 2 and 3 respectively changes the pitches of singing voice inference data for a given singer 217 for the "i/in" (first character(s)') in the "Ki/Twin" (the first character(s)), the "i/in (third character(s)') in the "Ki/twin" (the third character(s)), and the "a/le" (fourth character(s)') in the "Ra/kle" (the fourth character(s)) lyric strings being vocalized to the pitches G4, A4, and E4 specified by the CPU 201 and continue vocalizing this singing voice inference data for a given singer 217.

In other words, the pitches of singing voices already being output are changed.

Timings t1', t3', and t4' in FIG. 5C are used to describe control operation if the above-described control operation of the present embodiment were not performed in cases where, at timings t1', t3', and t4', which are not original vocalization timings, a user performs (presses) a key on the keyboard 101 in FIG. 1. If the control operation of the present embodiment were not performed, singing voices corresponding not to lyrics at original vocalization timings but to upcoming lyrics will be output at timings t1', t3', and t4' in FIG. 5C, and the lyrics will run ahead.

In this way, in cases where a user performs a performance operation at a timing other than an original vocalization timing, lyric progression runs ahead if the control operation of the present embodiment is not performed. This results in an unnatural-sounding progression. However, in the present embodiment, the pitch of the singing voice inference data for a given singer 217 being vocalized at such timing is changed to the pitch performed by the user and continues being vocalized. In this case, the pitches of singing voice inference data for a given singer 217 corresponding to "Ki/Twin" (the first character(s)), "Ki/twin" (the third character(s), and "Ra/kle" (the fourth character(s)) vocalized at, for example, the original song playback timings t1, t3, and t4 in FIG. 5B are heard to continuously change to the pitches specified by new key presses at key press timings t1', t3', and t4' without the singing voice inference data for a given singer 217 cutting out. This enables lyric progression to proceed naturally in the present embodiment.

Alternatively, when a user performs a performance operation at a timing other than an original vocalization timing, control may be such that a vocalization based on the singing voice inference data for a given singer 217 is performed anew at that timing with the pitch specified by the user. In this case, for example, following the singing voice inference data for a given singer 217 corresponding to "Ki/Twin" (the first character(s)), "Ki/twin" (the third character(s), and "Ra/kle" (the fourth character(s)) vocalized at the original song playback timings t1, t3, and t4 in FIG. 5B, singing voice inference data for a given singer 217 corresponding to "Ki/Twin" (the first character(s)), "Ki/twin" (the third character(s), and "Ra/kle" (the fourth character(s)) is heard separately vocalized at the pitches specified by the new key presses at keypress timings t1', t3', and t4'. Alternatively, control may be such that singing voice inference data for a given singer 217 is not vocalized at timings other than the vocalization timings.

Alternatively, when a user performs a performance operation at a timing other than an original vocalization timing, control may be such that instead of the singing voice inference data for a given singer 217 vocalized immediately before this timing, the singing voice inference data for a given singer 217 that is to be vocalized at a timing immediately thereafter may be vocalized early at such a timing at the pitch specified by the user. In this case, for example, before the arrival of the original song playback timings t2, t4, and t5 shown in FIG. 5A, at which singing voice inference data for a given singer 217 corresponding to the "Ra/kle" (the second character(s)), "Ra/kle" (the fourth character(s), and "Hi/lit" (the fifth character(s)) are to be vocalized, the singing voice inference data for a given singer 217 corresponding to the "Ra/kle" (the second character(s)), "Ra/kle" (the fourth character(s), and "Hi/lit" (the fifth character(s)) may be vocalized at the pitches specified by new key presses at key press timings t1', t3', and t4'.

Alternatively, when the user performs a performance operation at a timing other than an original vocalization timing and the specified pitch does not match the pitch is to be specified at the next timing, a vocalization corresponding to previously output singing voice inference data for a given singer 217 may be repeated (with the changed pitch). In this case, following the singing voice inference data for a given singer 217 corresponding to the "Ki/Twin" (the first character(s)) lyric data vocalized at, for example, the original song playback timing t1 in FIG. 5B, singing voice inference data for a given singer 217 corresponding to "Ki/Twin" (the first character(s)') due to a new key press at key press timing t1' is heard separately vocalized. Alternatively, control may be such that singing voice inference data for a given singer 217 is not vocalized at timings other than vocalization timings.

FIG. 6 is a diagram illustrating, for the present embodiment, an example data configuration for music data loaded into the RAM 203 from the ROM 202 in FIG. 2. This example data configuration conforms to the Standard MIDI (Musical Instrument Digital Interface) File format, which is one file format used for MIDI files. The music data is configured by data blocks called "chunks". Specifically, the music data is configured by a header chunk at the beginning of the file, a first track chunk that comes after the header chunk and stores lyric data for a lyric part, and a second track chunk that stores performance data for an accompaniment part.

The header chunk is made up of five values: ChunkID, ChunkSize, FormatType, NumberOfTrack, and TimeDivision. ChunkID is a four byte ASCII code "4D 54 68 64" (in base 16) corresponding to the four half-width characters "MThd", which indicates that the chunk is a header chunk. ChunkSize is four bytes of data that indicate the length of the FormatType, NumberOfTrack, and TimeDivision part of the header chunk (excluding ChunkID and ChunkSize). This length is always "00 00 00 06" (in base 16), for six bytes. FormatType is two bytes of data "00 01" (in base 16). This means that the format type is format 1, in which multiple tracks are used. NumberOfTrack is two bytes of data "00 02" (in base 16). This indicates that in the case of the present embodiment, two tracks, corresponding to the lyric part and the accompaniment part, are used. TimeDivision is data indicating a timebase value, which itself indicates resolution per quarter note. TimeDivision is two bytes of data "01 E0" (in base 16). In the case of the present embodiment, this indicates 480 in decimal notation.

The first and second track chunks are each made up of a ChunkID, ChunkSize, and performance data pairs. The performance data pairs are made up of DeltaTime_1[*i*] and Event_1[*i*] (for the first track chunk/lyric part), or DeltaTime_2[*i*] and Event_2[*i*] (for the second track chunk/accompaniment part). Note that $0 \leq i \leq L$ for the first track chunk/lyric part, and $0 \leq I \leq M$ for the second track chunk/accompaniment part. ChunkID is a four byte ASCII code "4D 54 72 6B" (in base 16) corresponding to the four half-width characters "MTrk", which indicates that the chunk is a track chunk. ChunkSize is four bytes of data that indicate the length of the respective track chunk (excluding ChunkID and ChunkSize).

DeltaTime_1[*i*] is variable-length data of one to four bytes indicating a wait time (relative time) from the execution time of Event_1[*i*-1] immediately prior thereto. Similarly, DeltaTime_2[*i*] is variable-length data of one to four bytes indicating a wait time (relative time) from the execution time of Event_2[*i*-1] immediately prior thereto. Event_1[*i*] is a meta event designating the vocalization timing and pitch of a lyric in the first track chunk/lyric part. Event_2[*i*] is a MIDI event designating "note on" or "note off" or is a meta event designating time signature in the second track chunk/accompaniment part. In each DeltaTime_1[*i*] and Event_1[*i*] performance data pair of the first track chunk/lyric part, Event_1[*i*] is executed after a wait of DeltaTime_1[*i*] from the execution time of the Event_1[*i*-1] immediately prior thereto. The vocalization and progression of lyrics is realized thereby. In each DeltaTime_2[*i*] and Event_2[*i*] performance data pair of the second track chunk/accompaniment part, Event_2[*i*] is executed after a wait of DeltaTime_2[*i*] from the execution time of the Event_2[*i*-1] immediately prior thereto. The progression of automatic accompaniment is realized thereby.

Figure 7:
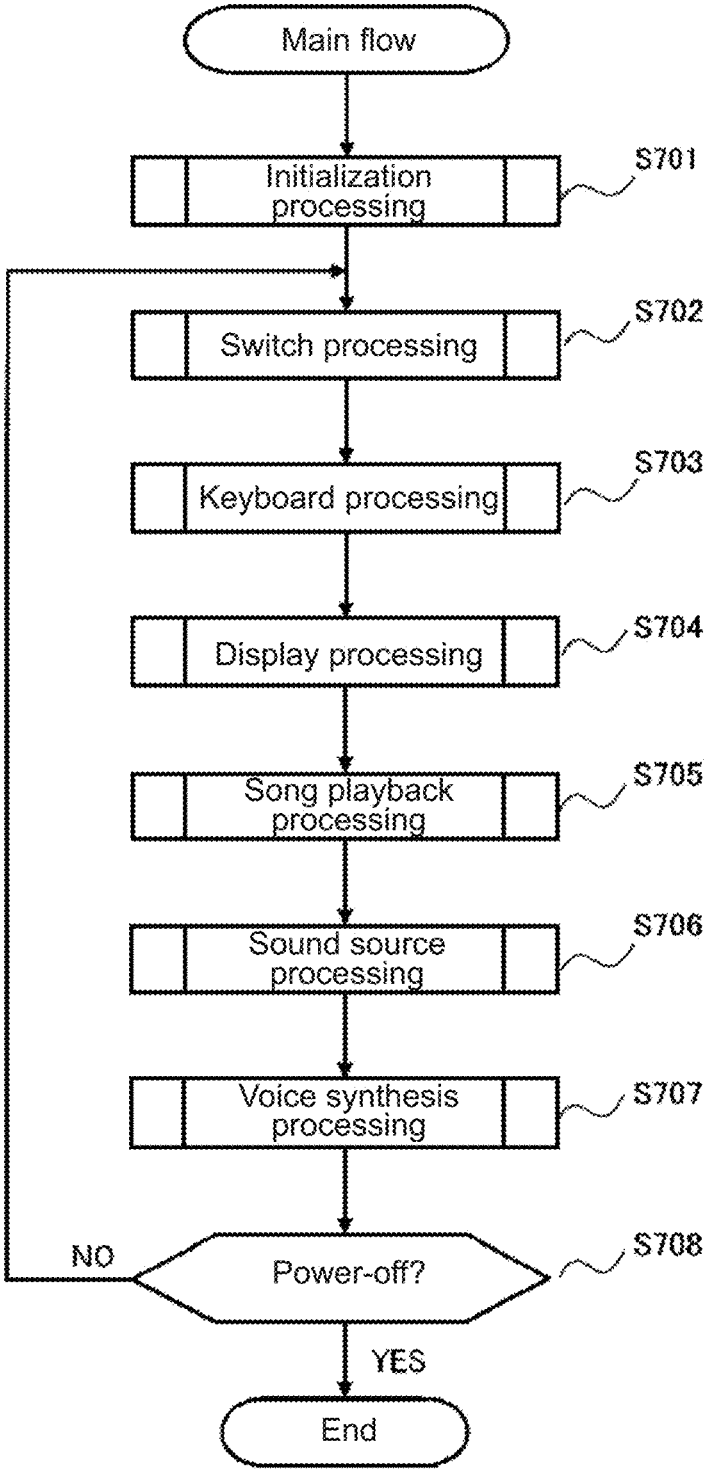
FIG. 7 is a main flowchart illustrating an example of a control process for the electronic musical instrument of the embodiment.

FIG. 7 is a main flowchart illustrating an example of a control process for the electronic musical instrument of the present embodiment. For this control process, for example, the CPU 201 in FIG. 2 executes a control processing program loaded into the RAM 203 from the ROM 202.

After first performing initialization processing (step S701), the CPU 201 repeatedly executes the series of processes from step S702 to step S708.

In this repeat processing, the CPU 201 first performs switch processing (step S702). Here, based on an interrupt from the key scanner 206 in FIG. 2, the CPU 201 performs processing corresponding to the operation of a switch on the first switch panel 102 or the second switch panel 103 in FIG. 1.

Next, based on an interrupt from the key scanner 206 in FIG. 2, the CPU 201 performs keyboard processing (step S703) that determines whether or not any of the keys on the keyboard 101 in FIG. 1 have been operated, and proceeds accordingly. Here, in response to an operation by a user pressing or releasing on any of the keys, the CPU 201 outputs sound generation control data 216 instructing the sound source LSI 204 in FIG. 2 to start generating sound or to stop generating sound.

Next, the CPU 201 performs song playback processing (step S705). In this processing, the CPU 201 performs a control process described in FIGS. 5A though 5C on the basis of a performance by a user, generates music data 215, and outputs this data to the voice synthesis LSI 205.

Next, the CPU 201 performs song playback processing (step S705). In this processing, the CPU 201 performs a control process described in FIG. 5 on the basis of a performance by a user, generates music data 215, and outputs this data to the voice synthesis LSI 205.

Then, the CPU 201 performs sound source processing (step S706). In the sound source processing, the CPU 201 performs control processing such as that for controlling the envelope of musical sounds being generated in the sound source LSI 204.

Then, the CPU 201 performs voice synthesis processing (step S707). In the voice synthesis processing, the CPU 201 controls voice synthesis by the voice synthesis LSI 205.

Finally, the CPU 201 determines whether or not a user has pressed a non-illustrated power-off switch to turn off the power (step S708). If the determination of step S708 is NO, the CPU 201 returns to the processing of step S702. If the determination of step S708 is YES, the CPU 201 ends the control process illustrated in the flowchart of FIG. 7 and powers off the electronic keyboard instrument 100.

Figure 8A:
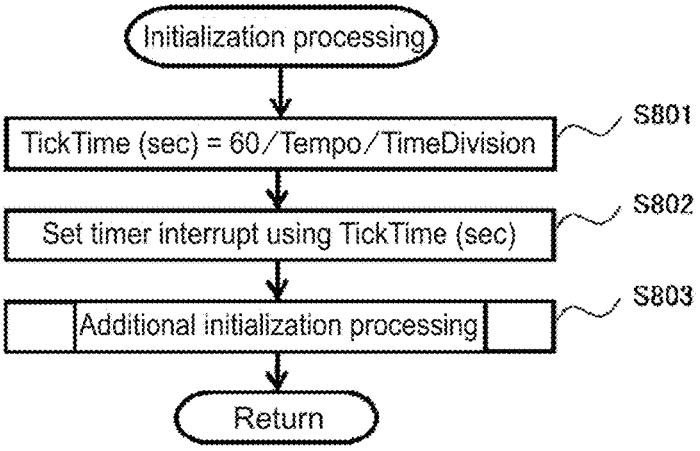
FIGS. 8A, 8B and 8C depict flowcharts illustrating detailed examples of initialization processing, tempo-changing processing, and song-starting processing, respectively.
Figure 8B:
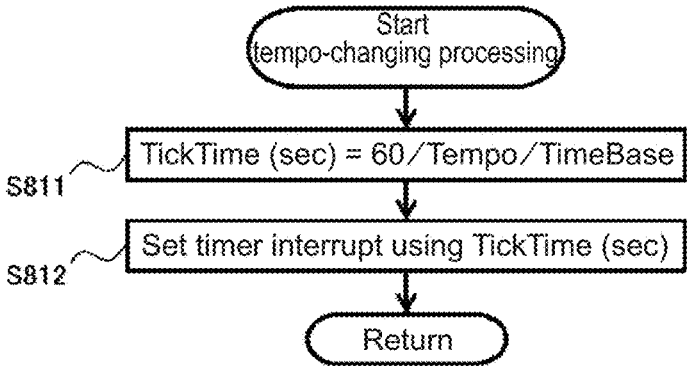
Figure 8C:
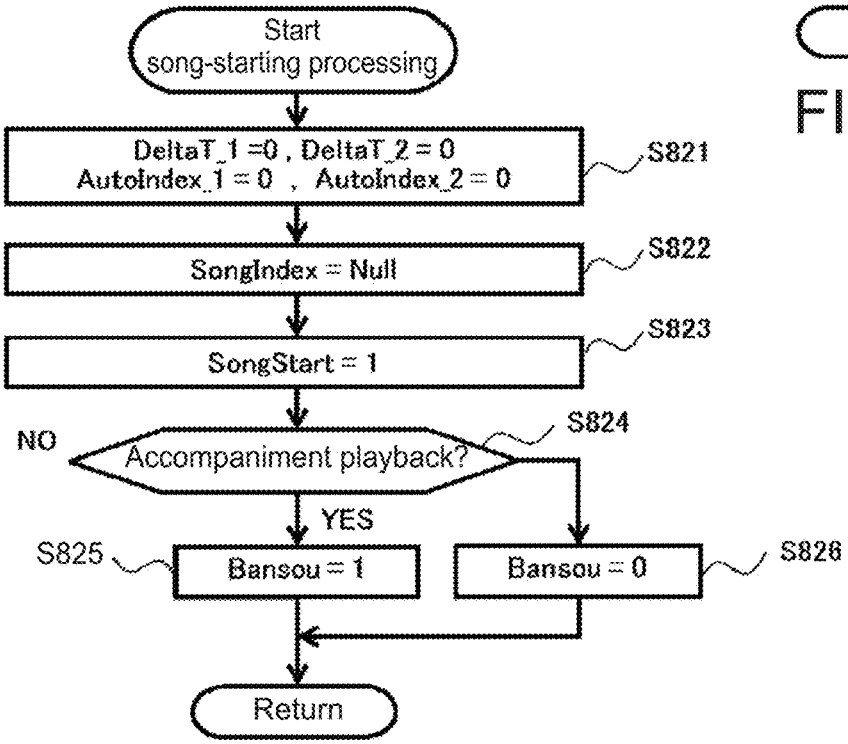

FIGS. 8A to 8C are flowcharts respectively illustrating detailed examples of the initialization processing at step S701 in FIG. 7; tempo-changing processing at step S902 in FIG. 9, described later, during the switch processing of step S702 in FIG. 7; and similarly, song-starting processing at step S906 in FIG. 9 during the switch processing of step S702 in FIG. 7, described later.

First, in FIG. 8A, which illustrates a detailed example of the initialization processing at step S701 in FIG. 7, the CPU 201 performs TickTime initialization processing. In the present embodiment, the progression of lyrics and automatic accompaniment progress in a unit of time called TickTime. The timebase value, specified as the TimeDivision value in the header chunk of the music data in FIG. 6, indicates resolution per quarter note. If this value is, for example, 480, each quarter note has a duration of 480 TickTime. The DeltaTime_1[*i*] values and the DeltaTime_2[*i*] values, indicating wait times in the track chunks of the music data in FIG. 6, are also counted in units of TickTime. The actual number of seconds corresponding to 1 TickTime differs depending on the tempo specified for the music data. Taking a tempo value as Tempo (beats per minute) and the timebase value as TimeDivision, the number of seconds per unit of TickTime is calculated using the following equation.

$$\text{TickTime (sec)}=60/\text{Tempo}/\text{TimeDivision} \quad (6)$$

Accordingly, in the initialization processing illustrated in the flowchart of FIG. 8A, the CPU 201 first calculates TickTime (sec) by an arithmetic process corresponding to Equation (6) (step S801). A prescribed initial value for the tempo value Tempo, e.g., 60 (beats per second), is stored in the ROM 202. Alternatively, the tempo value from when processing last ended may be stored in non-volatile memory.

Next, the CPU 201 sets a timer interrupt for the timer 210 in FIG. 2 using the TickTime (sec) calculated at step S801 (step S802). A CPU 201 interrupt for lyric progression and automatic accompaniment (referred to below as an "automatic-performance interrupt") is thus generated by the timer 210 every time the TickTime (sec) has elapsed. Accordingly, in automatic-performance interrupt processing (FIG. 10, described later) performed by the CPU 201 based on an automatic-performance interrupt, processing to control lyric progression and the progression of automatic accompaniment is performed every 1 TickTime.

Then, the CPU 201 performs additional initialization processing, such as that to initialize the RAM 203 in FIG. 2 (step S803). The CPU 201 subsequently ends the initialization processing at step S701 in FIG. 7 illustrated in the flowchart of FIG. 8A.

The flowcharts in FIGS. 8B and 8C will be described later. FIG. 9 is a flowchart illustrating a detailed example of the switch processing at step S702 in FIG. 7.

First, the CPU 201 determines whether or not the tempo of lyric progression and automatic accompaniment has been changed using a switch for changing tempo on the first switch panel 102 in FIG. 1 (step S901). If this determination is YES, the CPU 201 performs tempo-changing processing (step S902). The details of this processing will be described later using FIG. 8B. If the determination of step S901 is NO, the CPU 201 skips the processing of step S902.

Next, the CPU 201 determines whether or not a song has been selected with the second switch panel 103 in FIG. 1 (step S903). If this determination is YES, the CPU 201 performs song-loading processing (step S904). In this processing, music data having the data structure described in FIG. 6 is loaded into the RAM 203 from the ROM 202 in FIG. 2. Subsequent data access of the first track chunk or the second track chunk in the data structure illustrated in FIG. 6 is performed with respect to the music data that has been loaded into the RAM 203. If the determination of step S903 is NO, the CPU 201 skips the processing of step S904.

Then, the CPU 201 determines whether or not a switch for starting a song on the first switch panel 102 in FIG. 1 has been operated (step S905). If this determination is YES, the CPU 201 performs song-starting processing (step S906). The details of this processing will be described later using FIG. 8C. If the determination of step S905 is NO, the CPU 201 skips the processing of step S906.

Finally, the CPU 201 determines whether or not any other switches on the first switch panel 102 or the second switch panel 103 in FIG. 1 have been operated, and performs processing corresponding to each switch operation (step S907). The CPU 201 subsequently ends the switch processing at step S702 in FIG. 7 illustrated in the flowchart of FIG. 9

Figure 9:
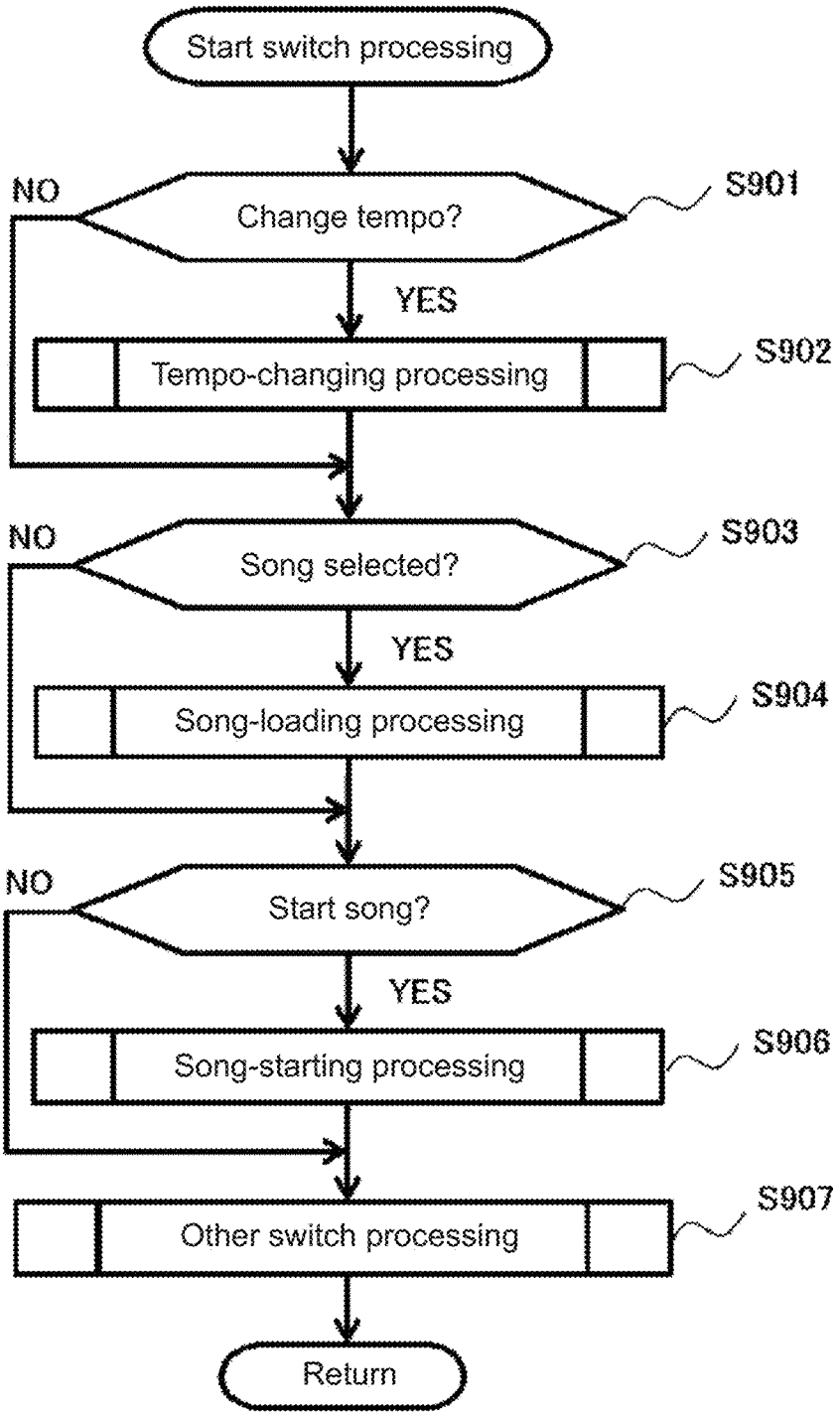
FIG. 9 is a flowchart illustrating a detailed example of switch processing.

FIG. 8B is a flowchart illustrating a detailed example of the tempo-changing processing at step S902 in FIG. 9. As mentioned previously, a change in the tempo value also results in a change in the TickTime (sec). In the flowchart of FIG. 8B, the CPU 201 performs a control process related to changing the TickTime (sec).

Similarly to at step S801 in FIG. 8A, which is performed in the initialization processing at step S701 in FIG. 7, the CPU 201 first calculates the TickTime (sec) by an arithmetic process corresponding to Equation (6) (step S811). It should be noted that the tempo value Tempo that has been changed using the switch for changing tempo on the first switch panel 102 in FIG. 1 is stored in the RAM 203 or the like.

Next, similarly to at step S802 in FIG. 8A, which is performed in the initialization processing at step S701 in FIG. 7, the CPU 201 sets a timer interrupt for the timer 210 in FIG. 2 using the TickTime (sec) calculated at step S811 (step S812). The CPU 201 subsequently ends the tempo-changing processing at step S902 in FIG. 9 illustrated in the flowchart of FIG. 8B FIG. 8C is a flowchart illustrating a detailed example of the song-starting processing at step S906 in FIG. 9.

First, with regards to the progression of automatic accompaniment, the CPU 201 initializes the values of both a DeltaT_1 (first track chunk) variable and a DeltaT_2 (second track chunk) variable in the RAM 203 for counting, in units of TickTime, relative time since the last event to 0. Next, the CPU 201 initializes the respective values of an AutoIndex_1 variable in the RAM 203 for specifying an i ($1 \leq i \leq L-1$) for DeltaTime_1[*i*] and Event_1[*i*] performance data pairs in the first track chunk of the music data illustrated in FIG. 6, and an AutoIndex_2 variable in the RAM 203 for specifying an i ($1 \leq i \leq M-1$) for DeltaTime_2[*i*] and Event_2[*i*] performance data pairs in the second track chunk of the music data illustrated in FIGS. 6, to 0 (the above is step S821). Thus, in the example of FIG. 6, the DeltaTime_1[0] and Event_1[0] performance data pair at the beginning of first track chunk and the DeltaTime_2[0] and Event_2[0] performance data pair at the beginning of second track chunk are both referenced to set an initial state.

Next, the CPU 201 initializes the value of a SongIndex variable in the RAM 203, which designates the current song position, to 0 (step S822).

The CPU 201 also initializes the value of a SongStart variable in the RAM 203, which indicates whether to advance (=1) or not advance (=0) the lyrics and accompaniment, to 1 (progress) (step S823).

Then, the CPU 201 determines whether or not a user has configured the electronic keyboard instrument 100 to playback an accompaniment together with lyric playback using the first switch panel 102 in FIG. 1 (step S824).

If the determination of step S824 is YES, the CPU 201 sets the value of a Bansou variable in the RAM 203 to 1 (has accompaniment) (step S825). Conversely, if the determination of step S824 is NO, the CPU 201 sets the value of the Bansou variable to 0 (no accompaniment) (step S826). After the processing at step S825 or step S826, the CPU 201 ends the song-starting processing at step S906 in FIG. 9 illustrated in the flowchart of FIG. 8C.

Figure 10:
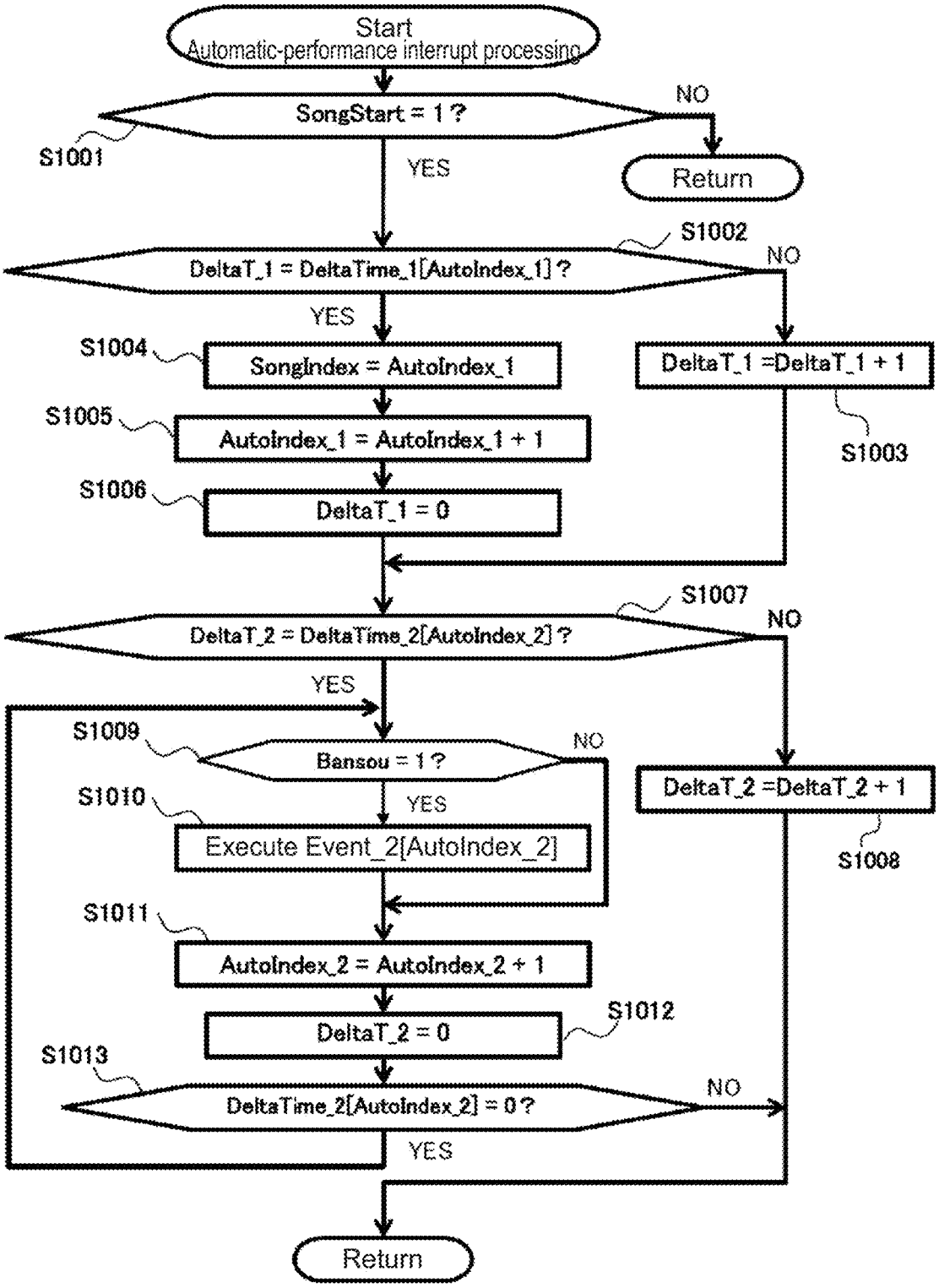
FIG. 10 is a flowchart illustrating a detailed example of automatic-performance interrupt processing.

FIG. 10 is a flowchart illustrating a detailed example of the automatic-performance interrupt processing performed based on the interrupts generated by the timer 210 in FIG. 2 every TickTime (sec) (see step S802 in FIG. 8A, or step S812 in FIG. 8B). The following processing is performed on the performance data pairs in the first and second track chunks in the music data illustrated in FIG. 6.

First, the CPU 201 performs a series of processes corresponding to the first track chunk (steps S1001 to S1006). The CPU 201 starts by determining whether or not the value of SongStart is equal to 1, in other words, whether or not advancement of the lyrics and accompaniment has been instructed (step S1001).

When the CPU 201 has determined there to be no instruction to advance the lyrics and accompaniment (the determination of step S1001 is NO), the CPU 201 ends the automatic-performance interrupt processing illustrated in the flowchart of FIG. 10 without advancing the lyrics and accompaniment.

When the CPU 201 has determined there to be an instruction to advance the lyrics and accompaniment (the determination of step S1001 is YES), the CPU 201 then determines whether or not the value of DeltaT_1, which indicates the relative time since the last event in the first track chunk, matches the wait time DeltaTime_1[AutoIndex_1] of the performance data pair indicated by the value of AutoIndex_1 that is about to be executed (step S1002).

If the determination of step S1002 is NO, the CPU 201 increments the value of DeltaT_1, which indicates the relative time since the last event in the first track chunk, by 1, and the CPU 201 allows the time to advance by 1 TickTime corresponding to the current interrupt (step S1003). Following this, the CPU 201 proceeds to step S1007, which will be described later.

If the determination of step S1002 is YES, the CPU 201 executes the first track chunk event Event-1[AutoIndex_1] of the performance data pair indicated by the value of AutoIndex_1 (step S1004). This event is a song event that includes lyric data.

Then, the CPU 201 stores the value of AutoIndex_1, which indicates the position of the song event that should be performed next in the first track chunk, in the SongIndex variable in the RAM 203 (step S1004).

The CPU 201 then increments the value of AutoIndex_1 for referencing the performance data pairs in the first track chunk by 1 (step S1005).

Next, the CPU 201 resets the value of DeltaT_1, which indicates the relative time since the song event most recently referenced in the first track chunk, to 0 (step S1006). Following this, the CPU 201 proceeds to the processing at step S1007.

Then, the CPU 201 performs a series of processes corresponding to the second track chunk (steps S1007 to S1013). The CPU 201 starts by determining whether or not the value of DeltaT_2, which indicates the relative time since the last event in the second track chunk, matches the wait time DeltaTime_2[AutoIndex_2] of the performance data pair indicated by the value of AutoIndex_2 that is about to be executed (step S1007).

If the determination of step S1007 is NO, the CPU 201 increments the value of DeltaT_2, which indicates the relative time since the last event in the second track chunk, by 1, and the CPU 201 allows the time to advance by 1 TickTime corresponding to the current interrupt (step S1008). The CPU 201 subsequently ends the automatic-performance interrupt processing illustrated in the flowchart of FIG. 10.

If the determination of step S1007 is YES, the CPU 201 then determines whether or not the value of the Bansou variable in the RAM 203 that denotes accompaniment playback is equal to 1 (has accompaniment) (step S1009) (see steps S824 to S826 in FIG. 8C).

If the determination of step S1009 is YES, the CPU 201 executes the second track chunk accompaniment event Event_2[AutoIndex_2] indicated by the value of AutoIndex_2 (step S1010). If the event Event_2[AutoIndex_2] executed here is, for example, a "note on" event, the key number and velocity specified by this "note on" event are used to issue a command to the sound source LSI 204 in FIG. 2 to generate sound for a musical tone in the accompaniment. However, if the event Event_2[AutoIndex_2] is, for example, a "note off" event, the key number and velocity specified by this "note off" event are used to issue a command to the sound source LSI 204 in FIG. 2 to silence a musical tone being generated for the accompaniment.

However, if the determination of step S1009 is NO, the CPU 201 skips step S1010 and proceeds to the processing at the next step S1011 without executing the current accompaniment event Event_2[AutoIndex_2]. Here, in order to progress in sync with the lyrics, the CPU 201 performs only control processing that advances events.

After step S1010, or when the determination of step S1009 is NO, the CPU 201 increments the value of Auto- Index_2 for referencing the performance data pairs for accompaniment data in the second track chunk by 1 (step S1011).

Next, the CPU 201 resets the value of DeltaT_2, which indicates the relative time since the event most recently executed in the second track chunk, to 0 (step S1012).

Then, the CPU 201 determines whether or not the wait time DeltaTime_2[AutoIndex_2] of the performance data pair indicated by the value of AutoIndex_2 to be executed next in the second track chunk is equal to 0, or in other words, whether or not this event is to be executed at the same time as the current event (step S1013).

If the determination of step S1013 is NO, the CPU 201 ends the current automatic-performance interrupt processing illustrated in the flowchart of FIG. 10.

If the determination of step S1013 is YES, the CPU 201 returns to step S1009, and repeats the control processing relating to the event Event_2[AutoIndex_2] of the performance data pair indicated by the value of AutoIndex_2 to be executed next in the second track chunk. The CPU 201 repeatedly performs the processing of steps S1009 to S1013 same number of times as there are events to be simultaneously executed. The above processing sequence is performed when a plurality of "note on" events are to generate sound at simultaneous timings, as for example happens in chords and the like.

Figure 11:
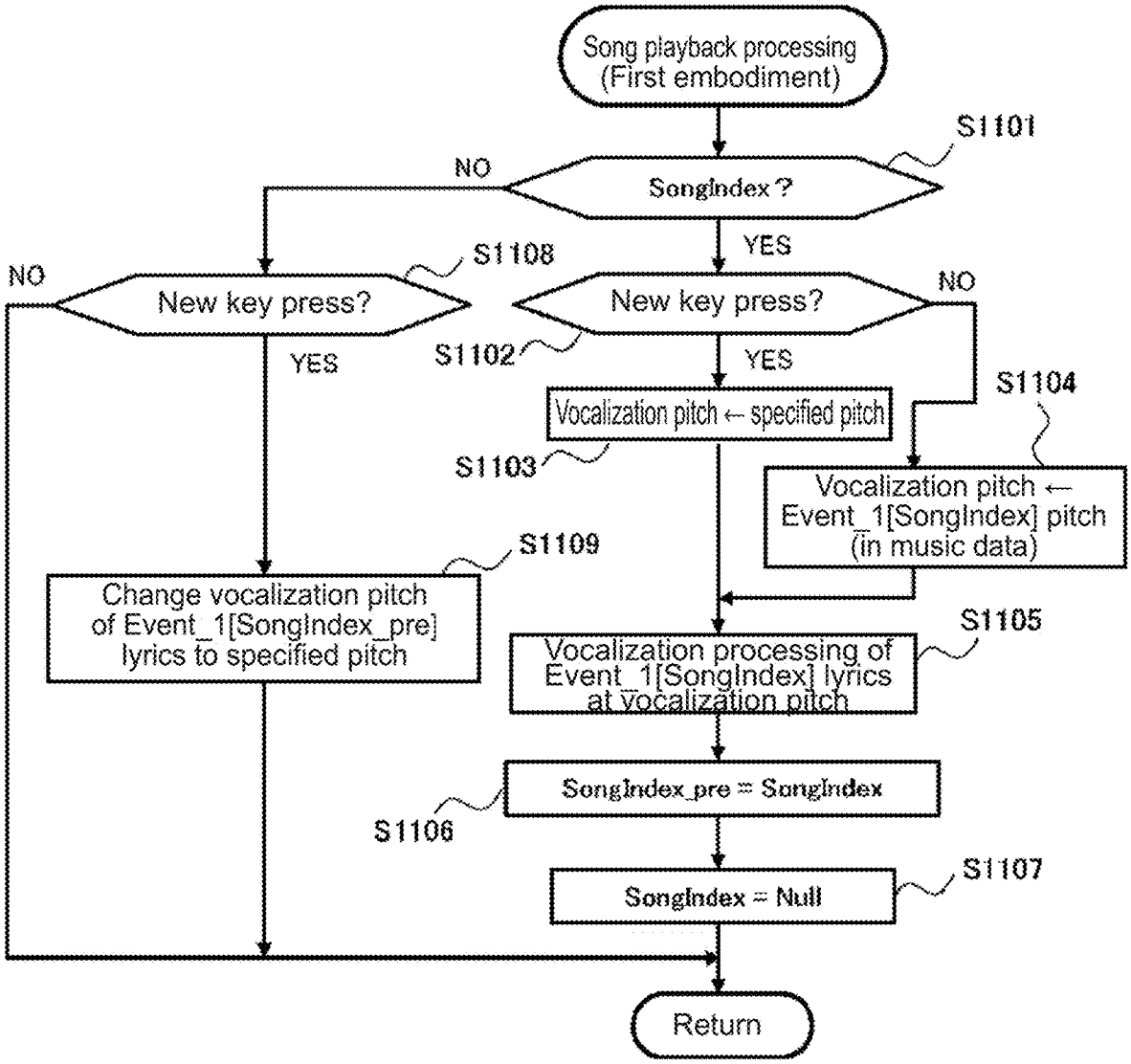
FIG. 11 is a flowchart illustrating a detailed example of a first embodiment of song playback processing.

FIG. 11 is a flowchart illustrating a detailed example of a first embodiment of the song playback processing at step S705 in FIG. 7. This processing implements a control process of the present embodiment described in FIGS. 5A to 5C.

If the determination of step S1101 is YES, that is, if the present time is a song playback timing (e.g., t1, t2, t3, t4 in the example of FIGS. 5A through 5C), the CPU 201 then determines whether or not a new user key press on the keyboard 101 in FIG. 1 has been detected by the keyboard processing at step S703 in FIG. 7 (step S1102).

If the determination of step S1102 is YES, the CPU 201 sets the pitch specified by a user key press to a non-illustrated register, or to a variable in the RAM 203, as a vocalization pitch (step S1103).

Then, the CPU 201 reads the lyric string from the song event Event_1[SongIndex] in the first track chunk of the music data in the RAM 203 indicated by the SongIndex variable in the RAM 203. The CPU 201 generates music data 215 for vocalizing, at the vocalization pitch set to the pitch specified based on key press that was set at step S1103, singing voice inference data for a given singer 217 corresponding to the lyric string that was read, and instructs the voice synthesis LSI 205 to perform vocalization processing (step S1105).

The processing at steps S1103 and S1105 corresponds to the control processing mentioned earlier with regards to the song playback timings t1, t2, or t4 in FIG. 5B.

However, in cases where the determination of step S1101 has determined that the present time is a song playback timing (e.g., t1, t2, t3, t4 in the example of FIGS. 5A through 5C) and the determination of step S1102 is NO, or in other words, that a new key press is not detected at the present time, the CPU 201 reads a pitch in data from the song event Event_1[SongIndex] in the first track chunk of the music data in the RAM 203 indicated by the SongIndex variable in the RAM 203, and sets this pitch to a non-illustrated register, or to a variable in the RAM 203, as a vocalization pitch (step S1104).

Then, by performing the processing at step S1105, described above, the CPU 201 generates music data 215 for vocalizing, at the vocalization pitch set at step S1104, singing voice inference data for a given singer 217 corresponding to the lyric string that was read from the song event Event_1[SongIndex], and instructs the voice synthesis LSI 205 to perform vocalization processing (step S1105).

The processing at steps S1104 and S1105 corresponds to the control processing mentioned earlier with regards to the song playback timing t3 in FIG. 5B.

After the processing of step S1105, the CPU 201 stores the song position at which playback was performed indicated by the SongIndex variable in the RAM 203 in a SongIndex_pre variable in the RAM 203 (step S1106).

Furthermore, the CPU 201 clears the value of the SongIndex variable so as to become a null value and makes subsequent timings non-song playback timings (step S1107). The CPU 201 subsequently ends the song playback processing at step S705 in FIG. 7 illustrated in the flowchart of FIG. 11.

If the determination of step S1101 is NO, that is, if the present time is not a song playback timing, the CPU 201 then determines whether or not a new user key press on the keyboard 101 in FIG. 1 has been detected by the keyboard processing at step S703 in FIG. 7 (step S1108).

If the determination of step S1108 is NO, the CPU 201 ends the song playback processing at step S705 in FIG. 7 illustrated in the flowchart of FIG. 11.

If the determination of step S1108 is YES, the CPU 201 generates music data 215 instructing that the pitch of singing voice inference data for a given singer 217 currently undergoing vocalization processing in the voice synthesis LSI 205, which corresponds to the lyric string for song event Event_1[SongIndex_pre] in the first track chunk of the music data in the RAM 203 indicated by the SongIndex_pre variable in the RAM 203, is to be changed to the pitch specified based on the user key press detected at step S1108, and outputs the music data 215 to the voice synthesis LSI 205 (step S1109). At such time, the frame in the music data 215 where a latter phoneme among phonemes in the lyrics already being subjected to vocalization processing starts, for example, in the case of the lyric string "Ki", the frame where the latter phoneme /i/ in the constituent phoneme sequence /k/ /i/ starts (see (b) and (c) in FIG. 4) is set as the starting point for changing to the specified pitch.

Due to the processing at step S1109, the pitches of vocalization of singing voice inference data for a given singer 217 that have been vocalized from original timings immediately before the current key press timings, for example from timings t1, t3, and t4 in FIG. 5B, are able to be changed to the specified pitches that was performed by the user and continue being vocalized at, for example, the current key press timings t1', t3', and t4' in FIG. 5B.

After the processing at step S1109, the CPU 201 ends the song playback processing at step S705 in FIG. 7 illustrated in the flowchart of FIG. 11.

Figure 12:
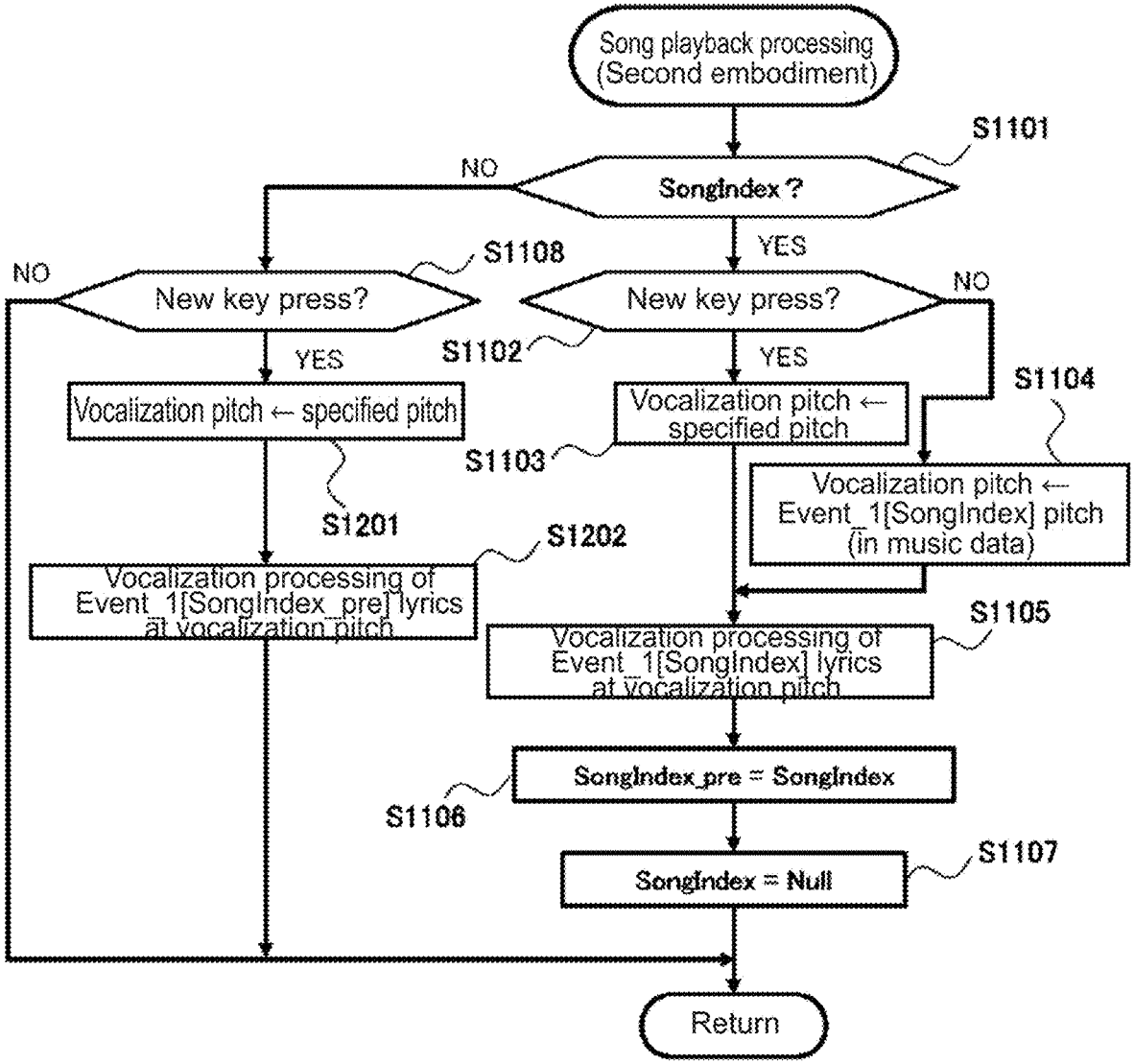
FIG. 12 is a flowchart illustrating a detailed example of a second embodiment of song playback processing.

FIG. 12 is a flowchart illustrating a detailed example of a second embodiment of the song playback processing at step S705 in FIG. 7. This processing implements another one of the control processes of the present embodiment described in FIGS. 5A through 5C. Steps in FIG. 12 having the same step number as in the first embodiment in FIG. 11 perform the same processing as in the first embodiment. Where the control process of the second embodiment in FIG. 12 differs from the control process of the first embodiment in FIG. 11 is in the control processing at steps S1201 and S1202. These occur when, as described in the first embodiment, the determination of step S1101 is NO, in other words when the present time is not a song playback timing, and when the determination of Step S1108 is YES, in other words when a new user key press has been detected.

In FIG. 12, if the determination of step S1108 is YES, the CPU 201 sets the pitch specified by a user key press to a non-illustrated register, or to a variable in the RAM 203, as a vocalization pitch (step S1201).

Then, the CPU 201 reads the lyric string from the song event Event_1[SongIndex] in the first track chunk of the music data in the RAM 203 indicated by the SongIndex variable in the RAM 203. The CPU 201 generates music data 215 for newly vocalizing, at the vocalization pitch set to the pitch specified based on key press that was set at step S1103, singing voice inference data for a given singer 217 corresponding to the lyric string that was read, and instructs the voice synthesis LSI 205 to perform vocalization processing (step S1202).

The CPU 201 subsequently ends the song playback processing at step S705 in FIG. 7 illustrated in the flowchart of FIG. 12.

As mentioned previously, the control process of the second embodiment has the effect that following the singing voice inference data for a given singer 217 corresponding to "Ki/Twin" (the first character(s)), "Ki/twin" (the third character(s), and "Ra/kle" (the fourth character(s)) vocalized at, for example, the original song playback timings t1, t3, and t4 in FIG. 5B, singing voice inference data for a given singer 217 corresponding to "Ki/Twin" (the first character(s)), "Ki/twin" (the third character(s), and "Ra/kle" (the fourth character(s)) is heard separately vocalized at the pitches specified by new key presses at keypress timings t1', t3', and t4'.

Figure 14:
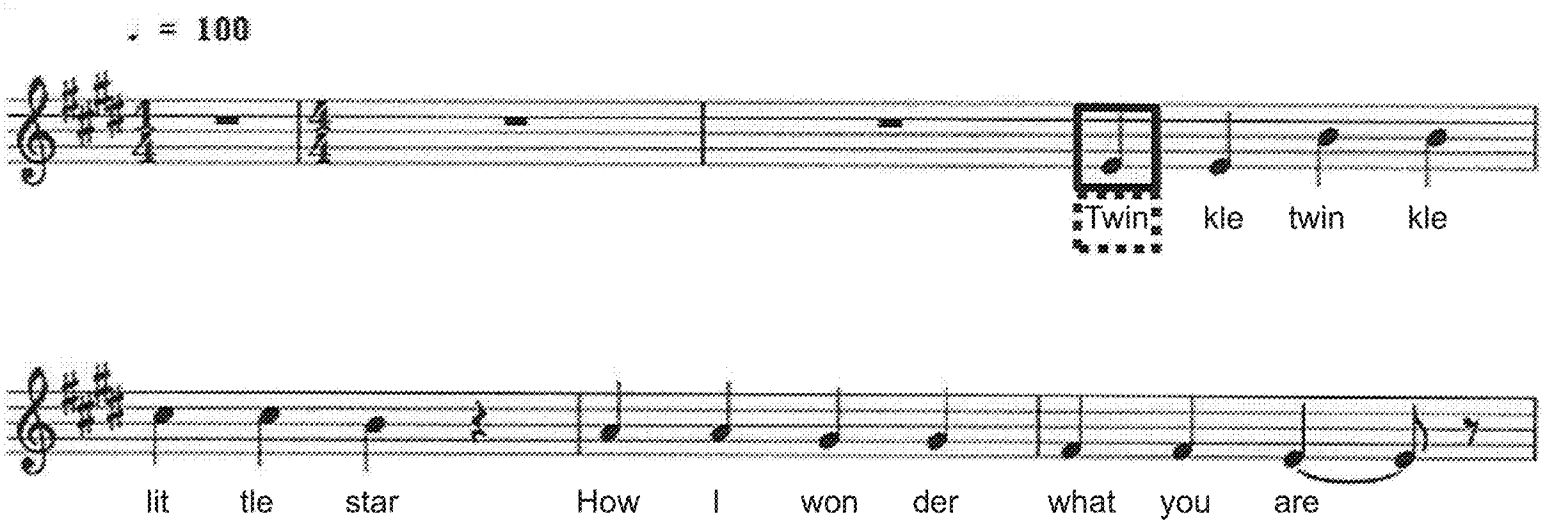
FIG. 14 illustrates an example of musical score display using lyric control data in the MusicXML format.

FIG. 13 illustrates an example configuration of music data having, for example, the data structure depicted in FIG. 6 when implemented in the MusicXML format. With this kind of data structure, musical score data including lyric strings (characters) and a melody (notes) can be held in the music data. Further, having the CPU 201 parse this kind of music data in, for example, the display processing at step S704 in FIG. 7 enables functionality to be provided whereby, for example, on the keyboard 101 in FIG. 1, keys for a melody corresponding to a lyric string in a song being played back are illuminated so as to guide the user in pressing keys corresponding to the lyric string. At the same time, the lyric strings in the song being played back and the corresponding musical score may be displayed in the LCD 104 in FIG. 1, as in a display example illustrated in FIG. 14. In other words, in order to induce a user to operate, from among a plurality of operation elements, a first operation element associated with a first tone at a timing corresponding to a first timing in the music data, a light source contained in the first operation element is illuminated starting at a timing that comes before the first timing, and light sources contained in operation elements other than the first operation element are not illuminated.

As used in the present specification, a "timing corresponding to a first timing" is a timing at which a user operation on the first operation element is received, and refers to an interval of a predetermined duration prior to the first timing.

Further, as used in the present specification, character(s) such as the "first character(s)" and the "second character(s)" denote character(s) associated with a single musical note, and may be either single characters or multiple characters.

If the determination of step S1202 is YES, that is, if the present time is a song playback timing (e.g., t1, t2, t3, t4 in the example of FIGS. 5A through 5C), the CPU 201 sets the pitch specified by a user key press to a non-illustrated register, or to a variable in the RAM 203, as a vocalization pitch (step S1203).

Then, the CPU 201 reads the lyric string from the song event Event_1[SongIndex] in the first track chunk of the music data in the RAM 203 indicated by the SongIndex variable in the RAM 203. The CPU 201 generates music data 215 for vocalizing, at the vocalization pitch set to the pitch specified based on key press that was set at step S1203, singing voice inference data for a given singer 217 corresponding to the lyric string that was read, and instructs the voice synthesis LSI 205 to perform vocalization processing (step S1204).

Following this, the CPU 201 reads a pitch from the song event Event_1[SongIndex] in the first track chunk of the music data in the RAM 203 indicated by the SongIndex variable in the RAM 203, and determines whether or not a specified pitch specified by a user key press matches the pitch that was read from the music data (step S1205).

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument comprising:

a performance receiver having a plurality of operation elements to be performed by a user for respectively specifying different pitches of musical notes;

a memory that stores musical piece data that includes data of a vocal part, the vocal part including at least a first note with a first pitch and an associated first lyric part that are to be played at a first timing; and at least one processor, wherein the at least one processor performs the following:

if the user specifies, via the performance receiver, a pitch in accordance with the first timing, digitally synthesizing a played first singing voice that includes the first lyric part and that has the pitch specified by the user regardless of whether the pitch specified by the user coincides with the first pitch, and causing the digitally synthesized played first singing voice to be audibly output at the first timing; and if the user does not operate any of the plurality of operation elements of the performance receiver in accordance with the first timing, digitally synthesizing a default first singing voice that includes the first lyric part and that has the first pitch in accordance with data of the first note stored in the memory, and causing the digitally synthesized default first singing voice to be audibly output at the first timing.

2. The electronic musical instrument according to claim 1, wherein the first lyric part has one more characters.

3. The electronic musical instrument according to claim 1, wherein the vocal part further includes a second note with a second pitch and an associated second lyric part that are to be played successively at a second timing after the first timing, and wherein if the user specifies, via the performance receiver, a third pitch in accordance with a third timing that is after the first timing and prior to the second timing while the played first singing voice or the default first singing voice is being output, the at least one processor causes a pitch of the played first singing voice or the default first singing voice that is being output to change to the third pitch and causes the pitch-changed played or default first singing voice to be audibly output at the third timing.

4. The electronic musical instrument according to claim 1, wherein each of the plurality of operation elements is provided with a light source to illuminate the corresponding operation element, and wherein the at least one processor causes, among the plurality of operation elements, an operation element that specifies the first pitch to be illuminated by the corresponding light source and causes the remaining operation elements not to be illuminated by the respective light sources at a timing corresponding the first timing, in order to indicate to the user that the user is supposed to operate the operation elements that specifies the first pitch in accordance with the first timing.

5. The electronic musical instrument according to claim 1, wherein the memory stores a trained acoustic model obtained using a machine learning process that employs musical score data including training lyric data and training pitch data, and singing voice data for a singer corresponding to the musical score data, the trained acoustic model being input with prescribed lyric data and prescribed pitch data and outputting data indicating acoustic features of the singing voice of the given singer, and wherein in singing voice syntheses, the at least one processor digitally synthesizes singing voices of the singer based on the data indicating acoustic features of the singing voice of the given singer output by the trained acoustic model in accordance with the input of the prescribed lyric data and the prescribed pitch data to the trained acoustic model.

6. The electronic musical instrument according to claim 5, wherein the trained acoustic model includes a model subjected to the machine learning process using at least one of a deep neural network or a hidden Markov model.

7. A method performed by at least one processor in an electronic musical instrument that includes, in addition to the at least processor: a performance receiver having a plurality of operation elements to be performed by a user for respectively specifying different pitches of musical notes; and a memory that stores musical piece data that includes data of a vocal part, the vocal part including at least a first note with a first pitch and an associated first lyric part that are to be played at a first timing, the method comprising, via the at least one processor, the following:

if the user specifies, via the performance receiver, a pitch in accordance with the first timing, digitally synthesizing a played first singing voice that includes the first lyric part and that has the pitch specified by the user regardless of whether the pitch specified by the user coincides with the first pitch, and causing the digitally synthesized played first singing voice to be audibly output at the first timing; and if the user does not operate any of the plurality of operation elements of the performance receiver in accordance with the first timing, digitally synthesizing a default first singing voice that includes the first lyric part and that has the first pitch in accordance with data of the first note stored in the memory, and causing the digitally synthesized default first singing voice to be audibly output at the first timing.

8. The method according to claim 7, wherein the first lyric part has one more characters.

9. The method according to claim 7, wherein the vocal part further includes a second note with a second pitch and an associated second lyric part that are to be played successively at a second timing after the first timing, and wherein if the user specifies, via the performance receiver, a third pitch in accordance with a third timing that is after the first timing and prior to the second timing while the played first singing voice or the default first singing voice is being output, the method further causes, via the at least one processor, a pitch of the played first singing voice or the default first singing voice that is being output to change to the third pitch and causes the pitch-changed played or default first singing voice to be audibly output at the third timing.

10. The method according to claim 7, wherein each of the plurality of operation elements is provided with a light source to illuminate the corresponding operation element, and wherein the method further causes, via the at least one processor, among the plurality of operation elements, an operation element that specifies the first pitch to be illuminated by the corresponding light source and causes the remaining operation elements not to be illuminated by the respective light sources at a timing corresponding the first timing, in order to indicate to the user that the user is supposed to operate the operation elements that specifies the first pitch in accordance with the first timing.

11. The method according to claim 7, wherein the memory stores a trained acoustic model obtained using a machine learning process that employs musical score data including training lyric data and training pitch data, and singing voice data for a singer corresponding to the musical score data, the trained acoustic model being input with prescribed lyric data and prescribed pitch data and outputting data indicating acoustic features of the singing voice of the given singer, and wherein in singing voice syntheses, the method causes at least one processor to digitally synthesize singing voices of the singer based on the data indicating acoustic features of the singing voice of the given singer output by the trained acoustic model in accordance with the input of the prescribed lyric data and the prescribed pitch data to the trained acoustic model.

12. The method according to claim 11, wherein the trained acoustic model includes a model subjected to the machine learning process using at least one of a deep neural network or a hidden Markov model.

13. A non-transitory computer-readable storage medium having stored thereon a program executable by at least one processor in an electronic musical instrument that includes, in addition to the at least processor: a performance receiver having a plurality of operation elements to be performed by a user for respectively specifying different pitches of musical notes; and a memory that stores musical piece data that includes data of a vocal part, the vocal part including at least a first note with a first pitch and an associated first lyric part that are to be played at a first timing, the program causing the at least one processor to perform the following:

if the user specifies, via the performance receiver, a pitch in accordance with the first timing, digitally synthesizing a played first singing voice that includes the first lyric part and that has the pitch specified by the user regardless of whether the pitch specified by the user coincides with the first pitch, and causing the digitally synthesized played first singing voice to be audibly output at the first timing; and if the user does not operate any of the plurality of operation elements of the performance receiver in accordance with the first timing, digitally synthesizing a default first singing voice that includes the first lyric part and that has the first pitch in accordance with data of the first note stored in the memory, and causing the digitally synthesized default first singing voice to be audibly output at the first timing.

* * * * *